US010717280B2

(12) United States Patent
Nishikawa et al.

(10) Patent No.: US 10,717,280 B2
(45) Date of Patent: Jul. 21, 2020

(54) HEAD CHIP, LIQUID JET HEAD AND LIQUID JET RECORDING DEVICE

(71) Applicant: SII Printek Inc., Chiba-shi, Chiba (JP)

(72) Inventors: Daichi Nishikawa, Chiba (JP); Misaki Kobayashi, Chiba (JP); Tomoki Kameyama, Chiba (JP)

(73) Assignee: SII Printek Inc., Chiba (JP)

( * ) Notice: Subject to any disclaimer, the term of this patent is extended or adjusted under 35 U.S.C. 154(b) by 0 days.

(21) Appl. No.: 16/186,983

(22) Filed: Nov. 12, 2018

(65) Prior Publication Data

US 2019/0143683 A1 May 16, 2019

(30) Foreign Application Priority Data

Nov. 13, 2017 (JP) ..... 2017-218102

(51) Int. Cl.
*B41J 2/14* (2006.01)

(52) U.S. Cl.
CPC ..... *B41J 2/1433* (2013.01); *B41J 2/14072* (2013.01); *B41J 2/14209* (2013.01); *B41J 2002/14491* (2013.01)

(58) Field of Classification Search
CPC .. B41J 2/14209; B41J 2/14201; B41J 2/1433; B41J 2002/14491; B41J 2002/14411; B41J 2202/11
See application file for complete search history.

(56) References Cited

U.S. PATENT DOCUMENTS 5,646,661 A * 7/1997 Asai ..... B41J 2/14209 347/68
5,680,163 A * 10/1997 Sugahara ..... B41J 2/14209 347/68
7,645,030 B2 * 1/2010 Koseki ..... B41J 2/14209 347/69
2014/0085379 A1 * 3/2014 Horiguchi ..... B41J 2/14209 347/40

(Continued)

FOREIGN PATENT DOCUMENTS

EP 2829404 A1 1/2015
EP 3150381 A1 4/2017

(Continued)

OTHER PUBLICATIONS

Extended European Search Report in EP Application No. 18206055.8, dated Mar. 20, 2019, 7 pages.

*Primary Examiner* — John Zimmermann
(74) *Attorney, Agent, or Firm* — Brinks Gilson & Lione

(57) ABSTRACT

There are provided a head chip, a liquid jet head, and a liquid jet recording device capable of enhancing the reliability. The head chip according to an embodiment of the disclosure is a head chip adapted to jet liquid including an actuator plate having a plurality of ejection grooves and a plurality of non-ejection grooves alternately arranged in parallel to each other along a first direction and each extending in a second direction crossing the first direction, and a nozzle plate having a plurality of nozzle holes individually communicated with the plurality of ejection grooves, and to be bonded to the actuator plate. The non-ejection grooves each partially open in a bonding surface of the actuator plate with the nozzle plate.

7 Claims, 13 Drawing Sheets

(56) References Cited

U.S. PATENT DOCUMENTS

| | | | | |
|---|---|---|---|---|
| 2014/0118440 | A1* | 5/2014 | Kubota | B41J 2/14209 347/40 |
| 2015/0035908 | A1 | 2/2015 | Domae et al. | |
| 2017/0173956 | A1 | 6/2017 | Nishikawa | |

FOREIGN PATENT DOCUMENTS

| | | | |
|---|---|---|---|
| JP | 2016-043484 | A | 4/2016 |
| JP | 2017-109386 | A | 6/2017 |

* cited by examiner

HEAD CHIP, LIQUID JET HEAD AND LIQUID JET RECORDING DEVICE

RELATED APPLICATIONS

This application claims priority under 35 U.S.C. § 119 to Japanese Patent Application No. 2017-218102 filed on Nov. 13, 2017, the entire content of which is hereby incorporated by reference.

BACKGROUND OF THE INVENTION

1. Field of the Invention

The present disclosure relates to a head chip, a liquid jet head and a liquid jet recording device.

2. Description of the Related Art

As one of liquid jet recording devices, there is provided an inkjet type recording device for ejecting (jetting) ink (liquid) on a recording target medium such as recording paper to perform recording of images, characters, and so on (see, e.g., JP-A-2017-109386).

In the liquid jet recording device of this type, it is arranged that the ink is supplied from an ink tank to an inkjet head (a liquid jet head), and then the ink is ejected from nozzle holes of the inkjet head toward the recording target medium to thereby perform recording of the images, the characters, and so on. Further, such an inkjet head is provided with a head chip for ejecting the ink.

In such a head chip or the like, in general, it is required to enhance the reliability. It is desirable to provide a head chip, a liquid jet head, and a liquid jet recording device capable of enhancing the reliability.

SUMMARY OF THE INVENTION

The head chip according to an embodiment of the disclosure is a head chip adapted to jet liquid including an actuator plate having a plurality of ejection grooves and a plurality of non-ejection grooves alternately arranged in parallel to each other along a first direction and each extending in a second direction crossing the first direction, and a nozzle plate having a plurality of nozzle holes individually communicated with the plurality of ejection grooves, and to be bonded to the actuator plate. The non-ejection grooves each partially open in a bonding surface of the actuator plate with the nozzle plate.

A liquid jet head according to an embodiment of the disclosure is equipped with the head chip according to an embodiment of the disclosure.

A liquid jet recording device according to an embodiment of the disclosure is equipped with the liquid jet head according to an embodiment of the disclosure, and a containing section adapted to contain the liquid.

According to the head chip, the liquid jet head and the liquid jet recording device related to an embodiment of the disclosure, it becomes possible to enhance the reliability.

DETAILED DESCRIPTION OF THE PREFERRED EMBODIMENTS

An embodiment of the present disclosure will hereinafter be described in detail with reference to the drawings. It should be noted that the description will be presented in the following order.

1. Embodiment (an example in which there is provided a structure in which each of non-ejection grooves partially opens in a bonding surface with a nozzle plate and is closed in an end surface in an actuator plate)
2. Modified Examples Modified Example 1 (an example in which an electrode dividing groove extends up to the end surface in the actuator plate)

Modified Example 2 (an example in which each of the non-ejection grooves opens in the end surface, and the electrode dividing groove extends up to the end surface in the actuator plate)

Modified Example 3 (an example in which the electrode dividing groove is exposed in an area from a first end surface to a second end surface in the actuator plate)

Modified Example 4 (a second example in which each of the non-ejection grooves opens in the end surface, and the electrode dividing groove extends up to the end surface in the actuator plate)

3. Other Modified Examples

1. Embodiment

[Overall Configuration of Printer 1]

Figure 1:
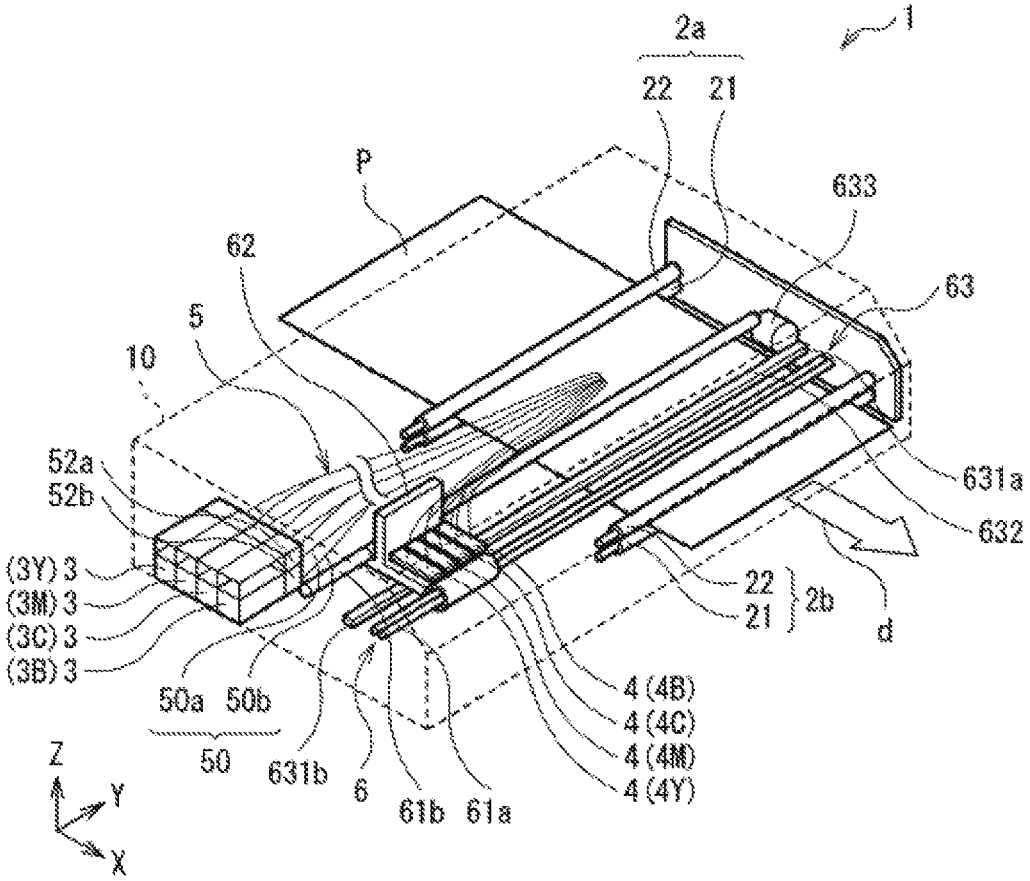
FIG. 1 is a schematic perspective view showing a schematic configuration example of a liquid jet recording device according to one embodiment of the disclosure.

FIG. 1 is a perspective view schematically showing a schematic configuration example of a printer 1 as a liquid jet recording device according to one embodiment of the present disclosure. The printer 1 is an inkjet printer for performing recording (printing) of images, characters, and so on, on recording paper P as a recording target medium using ink 9 described later.

As shown in FIG. 1, the printer 1 is provided with a pair of carrying mechanisms 2*a*, 2*b*, ink tanks 3, inkjet heads 4, a circulation mechanism 5, and a scanning mechanism 6. These members are housed in a housing 10 having a predetermined shape. It should be noted that the scale size of each member is accordingly altered so that the member is shown large enough to recognize in the drawings used in the description of the specification.

Here, the printer 1 corresponds to a specific example of the "liquid jet recording device" in the present disclosure, and the inkjet heads 4 (the inkjet heads 4Y, 4M, 4C, and 4B described later) each correspond to a specific example of a "liquid jet head" in the present disclosure. Further, the ink 9 corresponds to a specific example of the "liquid" in the present disclosure.

The carrying mechanisms 2*a*, 2*b* are each a mechanism for carrying the recording paper P along the carrying direction d (an X-axis direction) as shown in FIG. 1. These carrying mechanisms 2*a*, 2*b* each have a grit roller 21, a pinch roller 22 and a drive mechanism (not shown). The grit roller 21 and the pinch roller 22 are each disposed so as to extend along a Y-axis direction (the width direction of the recording paper P). The drive mechanism is a mechanism for rotating (rotating in a Z-X plane) the grit roller 21 around an axis, and is constituted by, for example, a motor.

(Ink Tanks 3)

The ink tanks 3 are each a tank for containing the ink 9 inside. As the ink tanks 3, there are disposed 4 types of tanks for individually containing 4 colors of ink 9, namely yellow (Y), magenta (M), cyan (C), and black (B), in this example as shown in FIG. 1. Specifically, there are disposed the ink tank 3Y for containing the yellow ink 9, the ink tank 3M for containing the magenta ink 9, the ink tank 3C for containing the cyan ink 9, and the ink tank 3B for containing the black ink 9. These ink tanks 3Y, 3M, 3C, and 3B are arranged side by side along the X-axis direction inside the housing 10.

It should be noted that the ink tanks 3Y, 3M, 3C, and 3B have the same configuration except the color of the ink 9 contained, and are therefore collectively referred to as ink tanks 3 in the following description. Further, the ink tanks 3 (3Y, 3M, 3C, and 3B) each correspond to a specific example of a "containing section" in the present disclosure.

(Inkjet Heads 4)

The inkjet heads 4 are each a head for jetting (ejecting) the ink 9 having a droplet shape from a plurality of nozzles (nozzle holes H1, H2) described later to the recording paper P to thereby perform recording of images, characters, and so on. As the inkjet heads 4, there are also disposed 4 types of heads for individually jetting the 4 colors of ink 9 respectively contained by the ink tanks 3Y, 3M, 3C, and 3B described above in this example as shown in FIG. 1. Specifically, there are disposed the inkjet head 4Y for jetting the yellow ink 9, the inkjet head 4M for jetting the magenta ink 9, the inkjet head 4C for jetting the cyan ink 9, and the inkjet head 4B for jetting the black ink 9. These inkjet heads 4Y, 4M, 4C, and 4B are arranged side by side along the Y-axis direction inside the housing 10.

It should be noted that the inkjet heads 4Y, 4M, 4C, and 4B have the same configuration except the color of the ink 9 used, and are therefore collectively referred to as inkjet heads 4 in the following description. Further, the detailed configuration of the inkjet heads 4 will be described later (FIG. 2 through FIG. 8).

(Circulation Mechanism 5)

The circulation mechanism 5 is a mechanism for circulating the ink 9 between the inside of the ink tanks 3 and the inside of the inkjet heads 4. The circulation mechanism 5 is configured including, for example, circulation channels 50 as flow channels for circulating the ink 9, and pairs of liquid feeding pumps 52*a*, 52*b*.

As shown in FIG. 1, the circulation channels 50 each have a flow channel 50*a* as a part extending from the ink tank 3 to reach the inkjet head 4 via the liquid feeding pump 52*a*, and a flow channel 50*b* as a part extending from the inkjet head 4 to reach the ink tank 3 via the liquid feeding pump 52*b*. In other words, the flow channel 50*a* is a flow channel through which the ink 9 flows from the ink tank 3 toward the inkjet head 4. Further, the flow channel 50*b* is a flow channel through which the ink 9 flows from the inkjet head 4 toward the ink tank 3. It should be noted that these flow channels 50*a*, 50*b* (supply tubes of the ink 9) are each formed of a flexible hose having flexibility.

(Scanning Mechanism 6)

The scanning mechanism 6 is a mechanism for making the inkjet heads 4 perform a scanning operation along the width direction (the Y-axis direction) of the recording paper P. As shown in FIG. 1, the scanning mechanism 6 has a pair of guide rails 61*a*, 61*b* disposed so as to extend along the Y-axis direction, a carriage 62 movably supported by these guide rails 61*a*, 61*b*, and a drive mechanism 63 for moving the carriage 62 along the Y-axis direction. Further, the drive mechanism 63 is provided with a pair of pulleys 631*a*, 631*b* disposed between the pair of guide rails 61*a*, 61*b*, an endless belt 632 wound between the pair of pulleys 631*a*, 631*b*, and a drive motor 633 for rotationally driving the pulley 631*a*.

The pulleys 631*a*, 631*b* are respectively disposed in areas corresponding to the vicinities of both ends in each of the guide rails 61*a*, 61*b*. To the endless belt 632, there is connected the carriage 62. On the carriage 62, there are disposed the four types of inkjet heads 4Y, 4M, 4C, and 4B arranged side by side along the Y-axis direction.

It should be noted that it is arranged that a moving mechanism for moving the inkjet heads 4 relatively to the recording paper P is constituted by such a scanning mechanism 6 and the carrying mechanisms 2*a*, 2*b* described above.

[Detailed Configuration of Inkjet Heads 4]

Then, the detailed configuration example of the inkjet heads 4 (head chips 41) will be described with reference to FIG. 2 through FIG. 8, in addition to FIG. 1.

Figure 2:
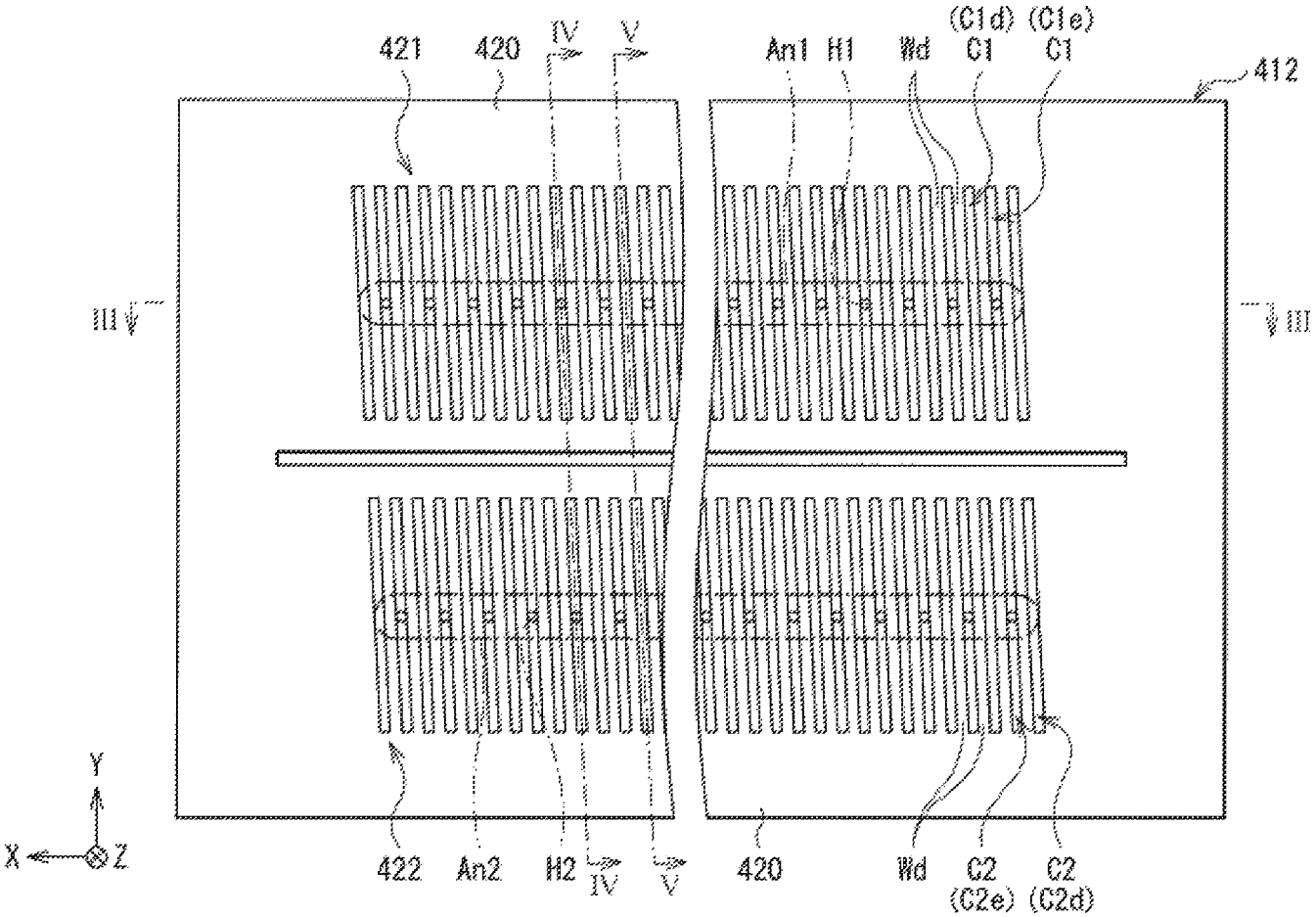
FIG. 2 is a schematic bottom view showing a configuration example of a substantial part of the liquid jet head shown in FIG. 1.
Figure 3:
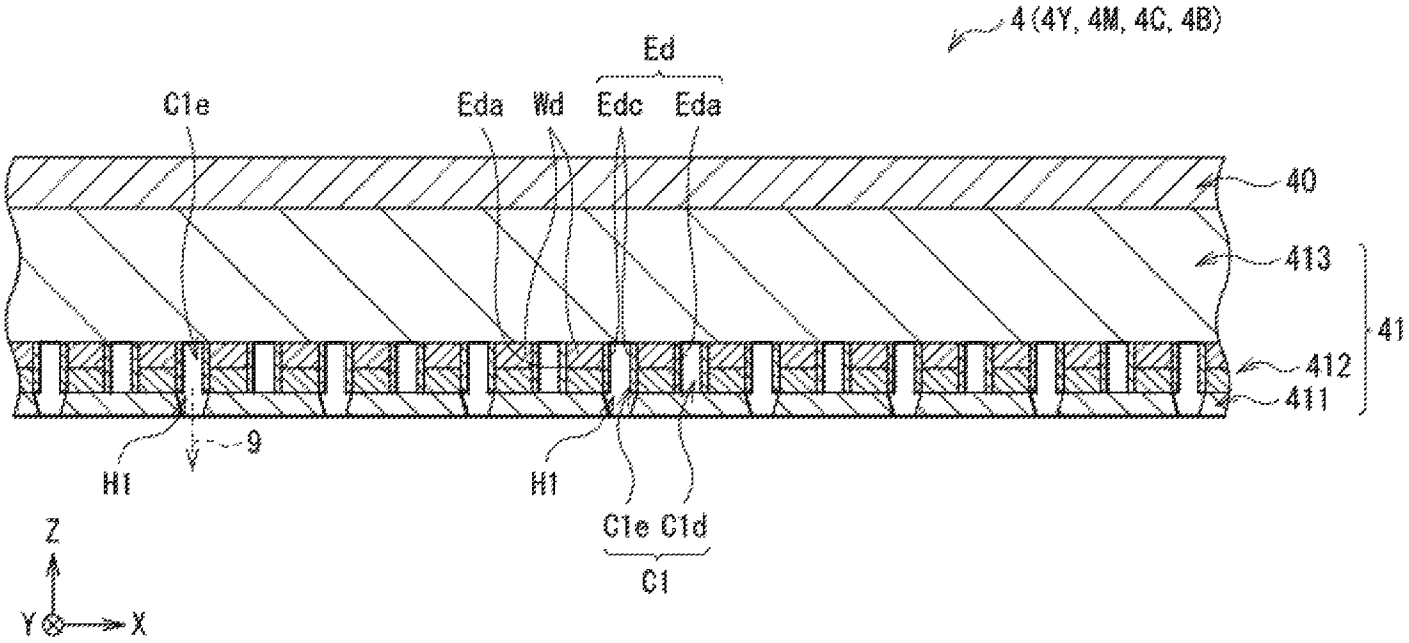
FIG. 3 is a schematic diagram showing a cross-sectional configuration example along the line III-III in the head chip shown in FIG. 2.
Figure 4:
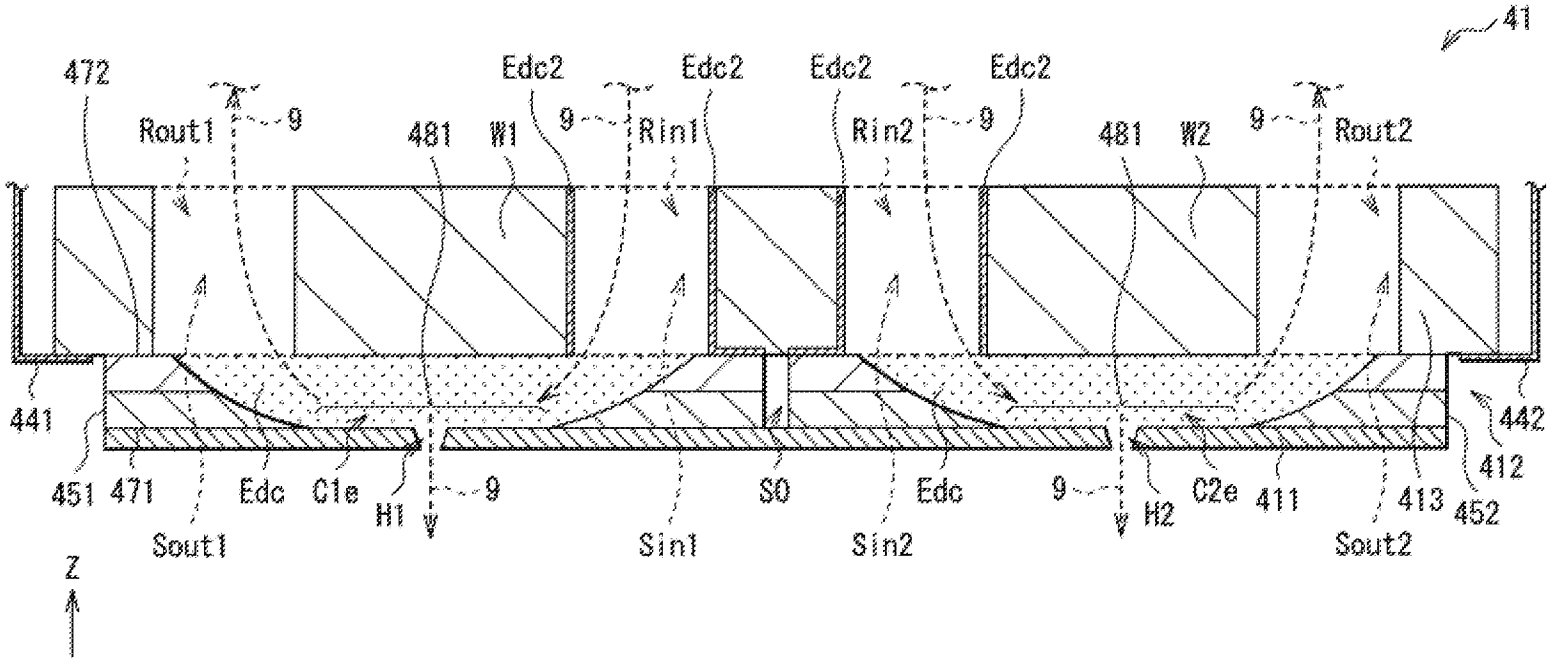
FIG. 4 is a schematic diagram showing a cross-sectional configuration example of the head chip along the line IV-IV shown in FIG. 2.
Figure 5:
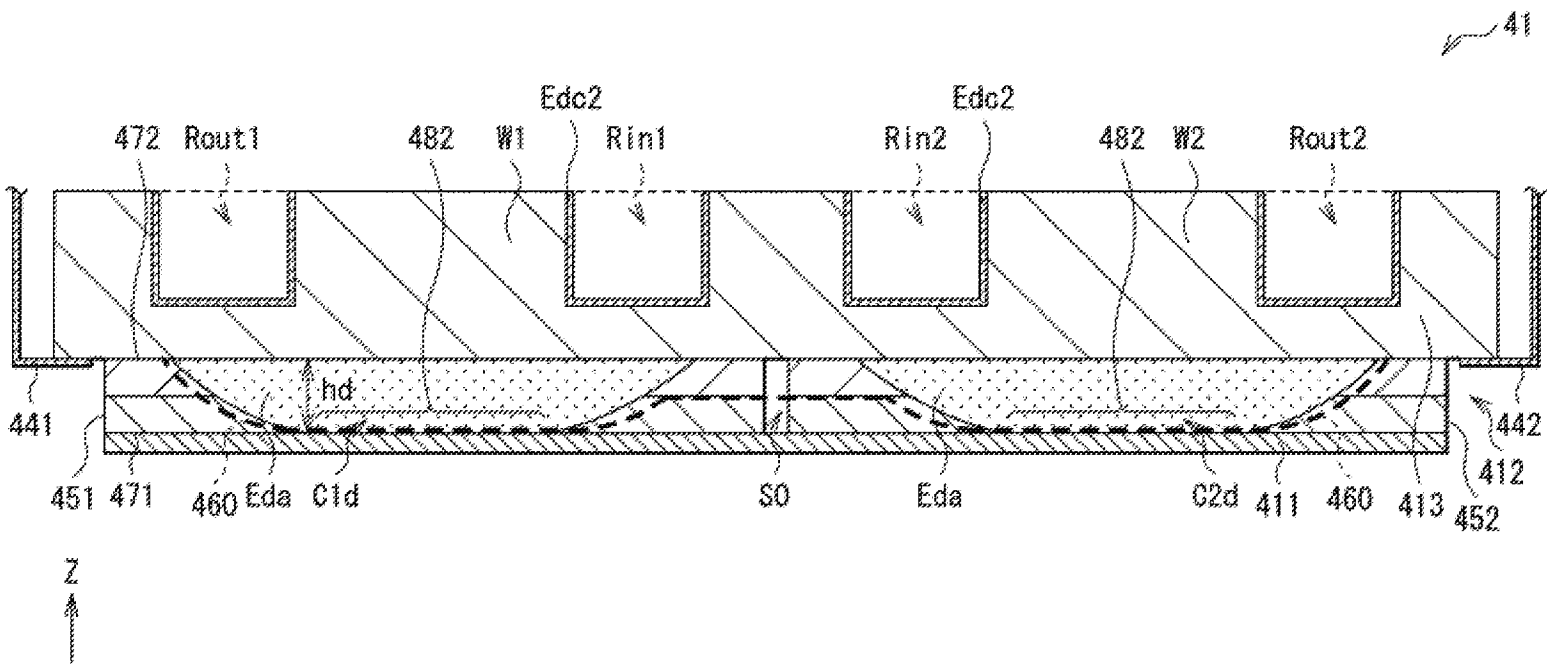
FIG. 5 is a schematic diagram showing a cross-sectional configuration example of the head chip along the line V-V shown in FIG. 2.
Figure 6:
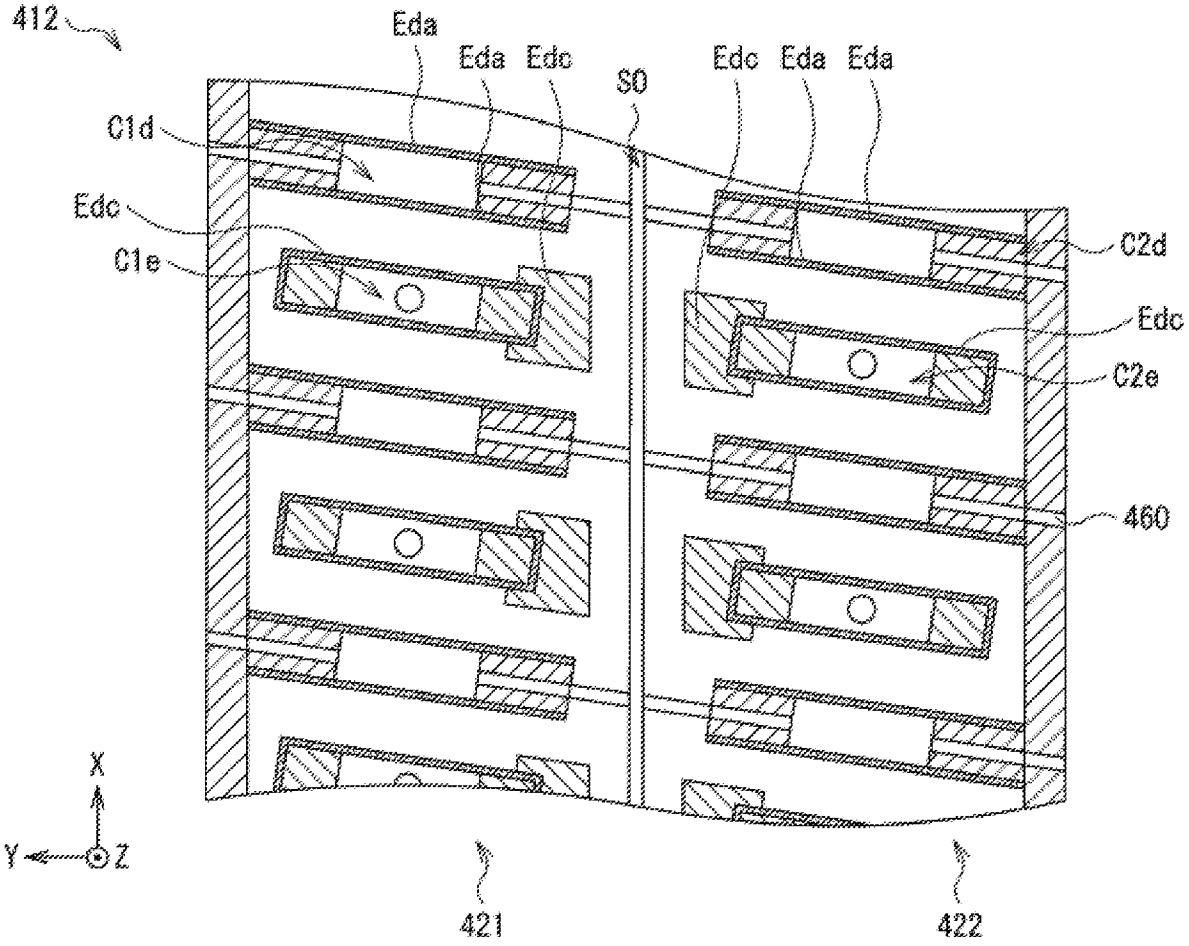
FIG. 6 is a top view showing a configuration example of a substantial part of an actuator plate in the head chip shown in FIG. 2.
Figure 7:
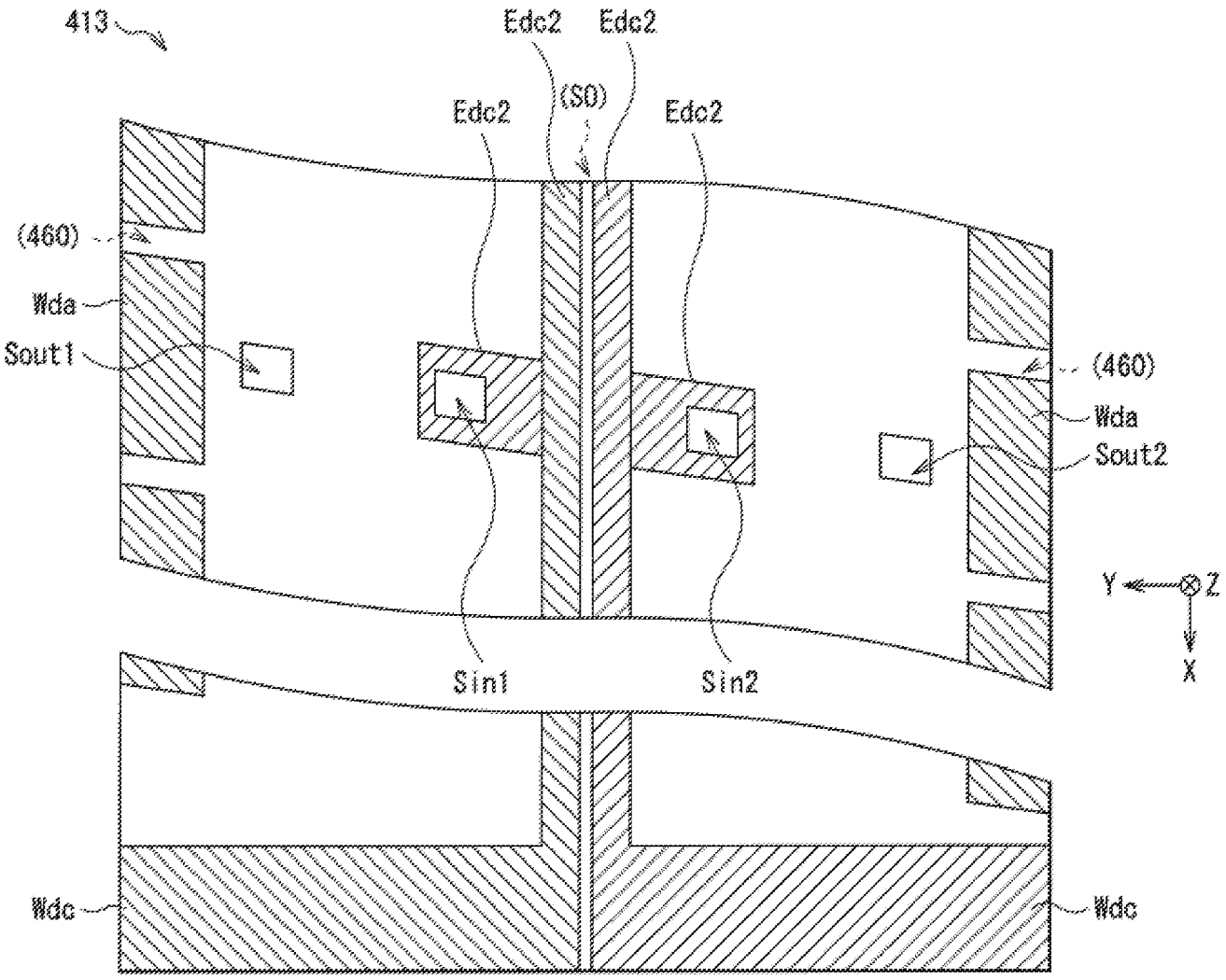
FIG. 7 is a bottom view showing a configuration example of a substantial part of a cover plate in the head chip shown in FIG. 2.
Figure 8:
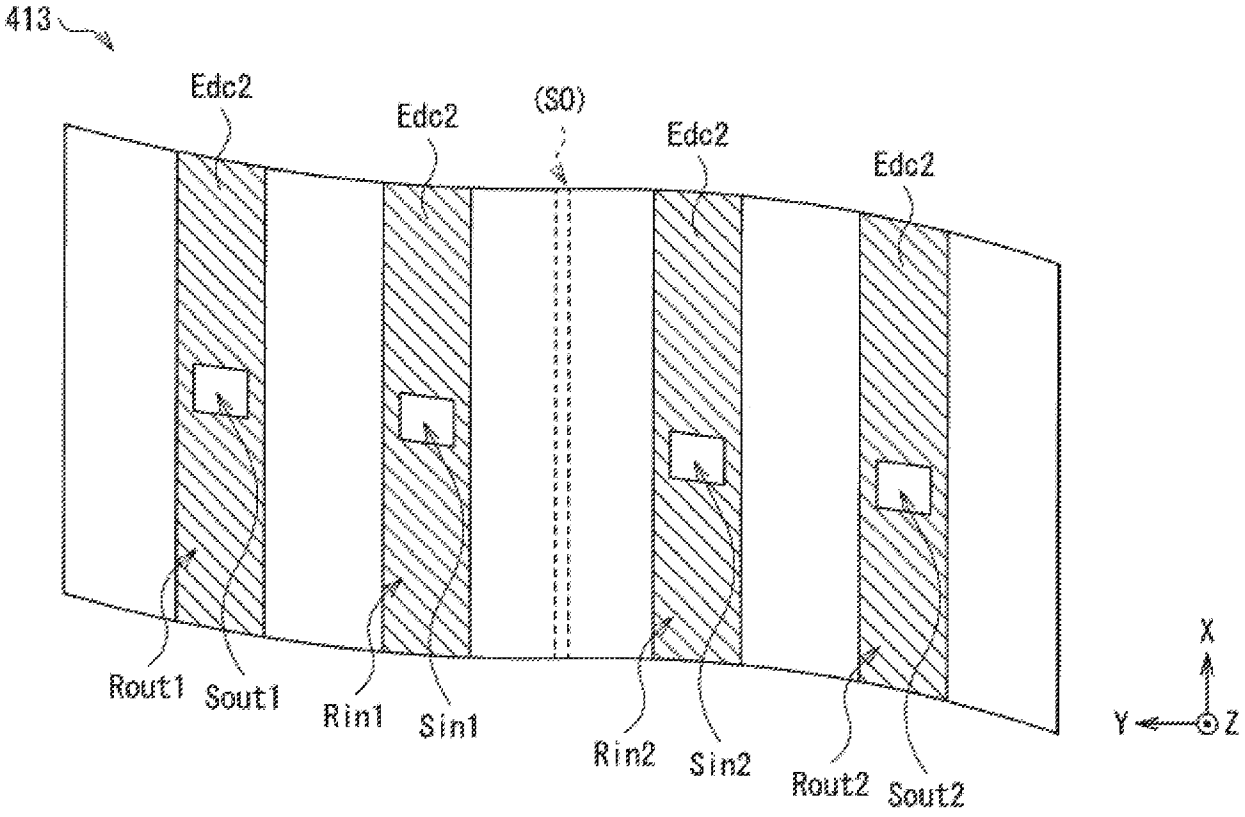
FIG. 8 is a top view showing a configuration example of a substantial part of the cover plate in the head chip shown in FIG. 2.

FIG. 2 is a diagram schematically showing a bottom view (an X-Y bottom view) of a configuration example of a substantial part of the inkjet head 4 in the state in which a nozzle plate 411 (described later) is removed. FIG. 3 is a diagram schematically showing a cross-sectional configuration example (a Z-X cross-sectional configuration example) of the inkjet head 4 along the line III-III shown in FIG. 2. Similarly, FIG. 4 is a diagram schematically showing a cross-sectional configuration example of the inkjet head 4 along the line IV-IV shown in FIG. 2, and corresponds to a cross-sectional configuration example of a vicinity of ejection channels C1*e*, C2*e* (ejection grooves) in the head chip 41 described later. Further, FIG. 5 is a diagram schematically showing a cross-sectional configuration example of the inkjet head 4 along the line V-V shown in FIG. 2, and corresponds to a cross-sectional configuration example of a vicinity of dummy channels C1*d*, C2*d* (non-ejection grooves) in the head chip 41 described later. FIG. 6 is a top view schematically showing a configuration example of a substantial part of an actuator plate 412 in the head chip 41 described later. FIG. 7 is a bottom view schematically showing a configuration example of a substantial part of a cover plate 413 in the head chip 41 described later. FIG. 8 is a top view schematically showing a configuration example of a substantial part of the cover plate 413 in the head chip 41 described later.

The inkjet heads 4 according to the present embodiment are each an inkjet head of a so-called side-shoot type for ejecting the ink 9 from a central part in an extending direction (an oblique direction described later) of the ejection channels C1*e*, C2*e* out of a plurality of channels (a plurality of channels C1 and a plurality of channels C2) in the head chip 41 described later. Further, the inkjet heads 4 are each an inkjet head of a circulation type which uses the circulation mechanism 5 (the circulation channel 50) described above to thereby use the ink 9 while circulated between the inkjet head 4 and the ink tank 3.

As shown in FIG. 3, the inkjet heads 4 are each provided with the head chip 41 and a flow channel plate 40. Further, the inkjet heads 4 are each provided with a circuit board (not shown) and flexible printed circuit boards (FPC) 441, 442 (see FIG. 4 and FIG. 5) as a control mechanism (a mechanism for controlling the operation of the head chip 41). It should be noted that it is also possible to adopt a structure (chip on FPC (COF)) in which the control mechanism (e.g., a driver IC) is mounted on the FPC.

The circuit board is a board for mounting a drive circuit (an electric circuit) for driving the head chip 41. The flexible printed circuit boards 441, 442 are each a board for electrically connecting the drive circuit on the circuit board and drive electrodes Ed described later in the head chip 41 to each other. It should be noted that it is arranged that such flexible printed circuit boards 441, 442 are each provided with a plurality of extraction electrodes described later as printed wiring.

As shown in FIG. 3, the head chip 41 is a member for jetting the ink 9 along the Z-axis direction, and is configured using a variety of types of plates. Specifically, as shown in FIG. 3, the head chip 41 is mainly provided with a nozzle plate (a jet hole plate) 411, an actuator plate 412 and a cover plate 413. The nozzle plate 411, the actuator plate 412, the cover plate 413, and the flow channel plate 40 described above are bonded to each other using, for example, an adhesive, and are stacked on one another in this order along the Z-axis direction. It should be noted that the description will hereinafter be presented with the flow channel plate 40 side (the cover plate 413 side) along the Z-axis direction referred to as an upper side, and the nozzle plate 411 side referred to as a lower side.

(Nozzle Plate 411)

The nozzle plate 411 is formed of a metal film material made of stainless steel or the like, and has a thickness of, for example, about 50 μm. It should be noted that the nozzle plate 411 can also be formed of a film material made of polyimide or the like. Further, the material of the nozzle plate 411 can also be glass or silicon. As shown in FIG. 3 and FIG. 4, the nozzle plate 411 is bonded to the lower surface (a bonding surface 471) of the actuator plate 412. Further, as shown in FIG. 2, the nozzle plate 411 is provided with two nozzle columns (nozzle columns An1, An2) each extending along the X-axis direction. These nozzle columns An1, An2 are arranged along the Y-axis direction with a predetermined distance. As described above, the inkjet head 4 (the head chip 41) of the present embodiment is formed as a tow-column type inkjet head (head chip).

The nozzle column An1 has a plurality of nozzle holes H1 formed in alignment with each other at predetermined intervals along the X-axis direction. These nozzle holes H1 each penetrate the nozzle plate 411 along the thickness direction of the nozzle plate 411 (the Z-axis direction), and are communicated with the respective ejection channels C1*e* in the actuator plate 412 described later as shown in, for example, FIG. 3 and FIG. 4. Specifically, as shown in FIG. 2, each of the nozzle holes H1 is formed so as to be located in a central part along the extending direction (an oblique direction described later) of the ejection channels C1*e*. Further, the formation pitch along the X-axis direction in the nozzle holes H1 is arranged to be equal (to have an equal pitch) to the formation pitch along the X-axis direction in the ejection channels C1*e*. Although the details will be described later, it is arranged that the ink 9 supplied from the inside of the ejection channel C1*e* is ejected (jetted) from each of the nozzle holes H1 in such a nozzle column An1.

The nozzle column An2 similarly has a plurality of nozzle holes H2 formed in alignment with each other at predetermined intervals along the X-axis direction. These nozzle holes H2 each penetrate the nozzle plate 411 along the thickness direction of the nozzle plate 411, and are individually communicated with the respective ejection channels C2*e* in the actuator plate 412 described later. Specifically, as shown in FIG. 2, each of the nozzle holes H2 is formed so as to be located in a central part along the extending direction (an oblique direction described later) of the ejection channels C2*e*. Further, the formation pitch along the X-axis direction in the nozzle holes H2 is arranged to be equal to the formation pitch along the X-axis direction in the ejection channels C2*e*. Although the details will be described later, it is arranged that the ink 9 supplied from the inside of the ejection channel C2*e* is also ejected from each of the nozzle holes H2 in such a nozzle column An2.

Further, as shown in FIG. 2, the nozzle holes H1 in the nozzle column An1 and the nozzle holes H2 in the nozzle column An2 are arranged in a staggered manner along the X-axis direction. Therefore, in each of the inkjet heads 4 according to the present embodiment, the nozzle holes H1 in the nozzle column An1 and the nozzle holes H2 in the nozzle column An2 are arranged in a zigzag manner. It should be noted that such nozzle holes H1, H2 each have a tapered through hole gradually decreasing in diameter toward the lower side.

(Actuator Plate 412)

The actuator plate 412 is a plate formed of a piezoelectric material such as lead zirconate titanate (PZT). As shown in FIG. 3, the actuator plate 412 is formed by stacking two piezoelectric substrates different in polarization direction from each other on one another along the thickness direction (the Z-axis direction) (a so-called chevron type). It should be noted that the configuration of the actuator plate 412 is not limited to the chevron type. Specifically, it is also possible to form the actuator plate 412 with, for example, a single (unique) piezoelectric substrate having the polarization direction set one direction along the thickness direction (the Z-axis direction) (a so-called cantilever type).

Further, as shown in FIG. 2, the actuator plate 412 is provided with two channel columns (channel columns 421, 422) each extending along the X-axis direction. These channel columns 421, 422 are arranged along the Y-axis direction with a predetermined distance.

In such an actuator plate 412, as shown in FIG. 2, an ejection area (jetting area) of the ink 9 is disposed in a central part (the formation areas of the channel columns 421, 422) along the X-axis direction. On the other hand, in the actuator plate 412, a non-ejection area (non-jetting area) of the ink 9 is disposed in each of the both end parts (non-formation areas of the channel columns 421, 422) along the X-axis direction. The non-ejection areas are located on the outer side along the X-axis direction with respect to the ejection area described above. It should be noted that the both end parts along the Y-axis direction in the actuator plate 412 each constitute a tail part 420 as shown in FIG. 2.

As shown in FIG. 2 and FIG. 3, the channel column 421 described above has the plurality of channels C1. As shown in FIG. 2, these channels C1 extend along an oblique direction forming a predetermined angle (an acute angle) with the Y-axis direction inside the actuator plate 412. Further, as shown in FIG. 2, these channels C1 are arranged side by side so as to be parallel to each other at predetermined intervals along the X-axis direction. Each of the channels C1 is partitioned with drive walls Wd formed of a piezoelectric body (the actuator plate 412), and forms a groove section having a recessed shape in a cross-sectional view (see FIG. 3).

As shown in FIG. 2, the channel column 422 similarly has the plurality of channels C2 extending along the oblique direction described above. As shown in FIG. 2, these channels C2 are arranged side by side so as to be parallel to each other at predetermined intervals along the X-axis direction. Each of the channels C2 is also partitioned with drive walls Wd described above, and forms a groove section having a recessed shape in a cross-sectional view.

Here, as shown in FIG. 2 through FIG. 6, in each of the channels C1, there exist the ejection channel C1*e* (the ejection groove) for ejecting the ink 9, and the dummy channel C1*d* (the non-ejection groove) not ejecting the ink 9. As shown in FIG. 2 and FIG. 3, in the channel column 421, the ejection channels C1*e* and the dummy channels C1*d* are alternately arranged along the X-axis direction. Each of the ejection channels C1*e* is communicated with the nozzle hole H1 in the nozzle plate 411 on the one hand, but each of the dummy channels C1*d* is not communicated with the nozzle hole H1, and is covered with the upper surface of the cover plate 411 from below on the other hand (see FIG. 3 through FIG. 5).

Similarly, as shown in FIG. 2, FIG. 4 and FIG. 5, in each of the channels C2, there exist the ejection channel C2*e* (the ejection groove) for ejecting the ink 9, and the dummy channel C2*d* (the non-ejection groove) not ejecting the ink 9. As shown in FIG. 2, in the channel column 422, the ejection channels C2*e* and the dummy channels C2*d* are alternately arranged along the X-axis direction. Each of the ejection channels C2*e* is communicated with the nozzle hole H2 in the nozzle plate 411 on the one hand, but each of the dummy channels C2*d* is not communicated with the nozzle hole H2, and is covered with the upper surface of the cover plate 411 from below on the other hand (see FIG. 4 and FIG. 5).

It should be noted that such ejection channels C1*e*, C2*e* each correspond to a specific example of the "ejection groove" in the present disclosure. Further, the dummy channels C1*d*, C2*d* each correspond to a specific example of the "non-ejection groove" in the present disclosure.

Further, as indicated by the line IV-IV in FIG. 2, the ejection channels C1*e* in the channel column 421 and the ejection channel C2*e* in the channel column 422 are disposed in alignment with each other (see FIG. 4) along the extending direction (the oblique direction described above) of these ejection channels C1*e*, C2*e*. Similarly, as indicated by the line V-V in FIG. 2, the dummy channels C1*d* in the channel column 421 and the dummy channel C2*d* in the channel column 422 are disposed in alignment with each other (see FIG. 5) along the extending direction (the oblique direction described above) of these dummy channels C1*d*, C2*d*.

Here, as shown in FIG. 3, the drive electrode Ed extending along the oblique direction described above is disposed on each of the inside surfaces opposed to each other in the drive walls Wd described above. As the drive electrodes Ed, there exist common electrodes Edc disposed on the inner side surfaces facing the ejection channels C1*e*, C2*e*, and individual electrodes (active electrodes) Eda disposed on the inner side surfaces facing the dummy channels C1*d*, C2*d*. It should be noted that such drive electrodes Ed (the common electrodes Edc and the active electrodes Eda) are each formed in the entire area in the depth direction (the Z-axis direction) on the inner side surface of the drive wall Wd as shown in FIG. 3.

The pair of common electrodes Edc opposed to each other in the same ejection channel C1*e* (or the same ejection channel C2*e*) are electrically connected to each other (see FIG. 6). Further, the pair of individual electrodes Eda opposed to each other in the same dummy channel C1*d* (or the same dummy channel C2*d*) are electrically separated from each other by an electrode dividing groove 460 (see FIG. 5) as described later. In contrast, the pair of individual electrodes Eda opposed to each other via the ejection channel C1*e* (or the ejection channel C2*e*) are electrically connected to each other in an individual terminal (an individual interconnection Wda) provided to the cover plate 413 described later (see FIG. 7).

Here, in the tail parts 420 described above, there are respectively mounted the flexible printed circuit boards 441, 442 (see FIG. 4 and FIG. 5) described above for electrically connecting the drive electrodes Ed and the circuit board described above to each other. The interconnection patterns (not shown) provided to these flexible printed circuit boards 441, 442 are electrically connected to the common interconnections Wdc and the individual interconnections Wda (see FIG. 7) provided to the cover plate 413 described above. Thus, it is arranged that the drive voltage is applied to each of the drive electrodes Ed from the drive circuit on the circuit board described above via these flexible printed circuit boards 441, 442.

The actuator plate 412 has the groove section S0 extending in the X-axis direction (see FIG. 6). The groove section S0 is formed between the ejection channel C1*e* and the ejection channel C2*e*, and between the dummy channel C2*d* and the dummy channel C2*d* (see FIG. 4 through FIG. 6).

In the head chip 41, the common electrodes Edc in the plurality of ejection channels C1*e* are electrically connected to each other in the vicinity (on the bottom surface of the cover plate 413) of the groove section S0 or the side surfaces of the entrance side common ink chamber Rin1, and are extracted as a common electrode Edc2. The common electrode Edc2 is extracted from the vicinity of the groove section S0 to the inside of the entrance side common ink chamber Rin1.

Similarly, in the head chip 41, the common electrodes Edc in the plurality of ejection channels C2*e* are electrically connected to each other in the vicinity (on the bottom surface of the cover plate 413) of the groove section S0 described above or the side surfaces of the entrance side common ink chamber Rin2, and are extracted as the common electrode Edc2. The common electrode Edc2 is extracted from the vicinity of the groove section S0 to the inside of the entrance side common ink chamber Rin2.

The actuator plate 412 has the bonding surface 471 with the nozzle plate 411 and a bonding surface 472 with the cover plate 413 (see FIG. 4 and FIG. 5).

Here, the X-axis direction corresponds to a specific example of a "first direction" in the present disclosure. Further, the direction (the oblique direction described above) in which the ejection channels C1*e*, C2*e* and the dummy channels C1*d*, C2*d* extend corresponds to a specific example of a "second direction (a direction crossing the first direction)" in the present disclosure.

The ejection channels C1*e*, C2*e* partially open in the bonding surface 471 of the actuator plate 412 with the nozzle plate 411 to form openings 481 (see FIG. 4). In each of the ejection channels C1*e*, C2*e*, the opening 481 is formed at roughly the center in the second direction. In the bonding surface 471 of the actuator plate 412 with the nozzle plate 411, in the extending direction (a second direction) of the ejection channels C1*e*, C2*e*, a part of the ejection channel C1*e*, C2*e* is blocked by the bottom part of the ejection channel C1*e*, C2*e*, and at the same time, the other part of the ejection channel C1*e*, C2*e* partially opens.

The dummy channel C1*d*, C2*d* partially opens in the bonding surface 471 of the actuator plate 412 with the nozzle plate 411 to form an opening 482 (see FIG. 5). In each of the dummy channels C1*d*, C2*d*, the opening 482 is formed at roughly the center in the second direction. In the bonding surface 471 of the actuator plate 412 with the nozzle plate 411, in the extending direction (the second direction) of the dummy channels C1*d*, C2*d*, a part of the dummy channel C1*d*, C2*d* is blocked by the bottom part of the dummy channel C1*d*, C2*d*, and at the same time, the other part of the dummy channel C1*e*, C2*e* partially opens.

It should be noted that as shown in FIG. 4, the ejection channels C1*e*, C2*e* each have arc-like side surfaces with which the cross-sectional area of each of the ejection channels C1*e*, C2*e* gradually decreases in a direction from the cover plate 413 side (upper side) toward the nozzle plate 411 side (lower side). It is arranged that the arc-like side surfaces of such ejection channels C1*e*, C2*e* are each formed by, for example, cutting work using a dicer.

Similarly, as shown in FIG. 5, the dummy channels C1*d*, C2*d* each have arc-like side surfaces with which the cross-sectional area of each of the dummy channels C1*d*, C2*d* gradually decreases in a direction from the cover plate 413 side (upper side) toward the nozzle plate 411 side (lower side). Thus, in the second direction, the groove depth hd in each of the dummy channels C1*d*, C2*d* is deep at the center, and becomes shallower in a direction toward the side surface. It is arranged that the arc-like side surfaces of such dummy channels C1*d*, C2*d* are each formed by, for example, cutting work using a dicer.

In the second direction described above, the actuator plate 412 has a first end surface 451, and a second end surface 452 facing to an opposite side to the first end surface 451 (opposed to the first end surface 451) as predetermined end surfaces. The dummy channels C1*d*, C2*d* are each provided with a structure of being closed in the predetermined end surface of the actuator plate 412 in the second direction described above (see FIG. 5). The electrode dividing groove 460 is formed on the inner side of the predetermined end surfaces of the actuator plate 412 in the second direction described above (see FIG. 5).

It should be noted that as a method of forming the drive electrodes Ed (the common electrodes Edc and the individual electrodes Eda) in the actuator plate 412, there can be cited a method of forming the drive electrodes Ed by plating, a method of forming the drive electrodes Ed by vapor deposition, and a method of forming the drive electrodes Ed by sputtering. In the inkjet heads 4 according to the present embodiment, as described above, the drive electrodes Ed are each formed in the entire area in the depth direction (the Z-axis direction) on the inner side surface of the drive wall Wd as shown in FIG. 3. In this case, the drive electrodes Ed are formed by, for example, plating. In this case, there is a possibility that a pair of individual electrodes Eda opposed to each other in the same dummy channel C1*d* (or the same dummy channel C2*d*) extend up to the bottom surface side in the channel, and the pair of individual electrodes Eda are electrically connected to each other. Therefore, it can be necessary to electrically separate the pair of individual electrodes Eda, which are opposed to each other in the same dummy channel C1*d* (or the same dummy channel C2*d*), from each other in the bottom surface side inside the channel by processing such as an electrode dividing groove 460 (see FIG. 5). The electrode dividing groove 460 extends along the second direction. The electrode dividing groove 460 is provided to the bottom surface of each of the dummy channels C1*d*, C2*d* so as to electrically separate the pair of individual electrodes Eda respectively into one side surface side and the other side surface side in each of the dummy channels C1*d*, C2*d*.

In contrast, as a modified example with respect to the inkjet heads 4 according to the present embodiment, it is also possible to adopt a configuration in which each of the drive electrodes Ed is not formed beyond an intermediate position in the depth direction on the inner side surface of the drive wall Wd. In this case, the drive electrodes Ed are formed by, for example, oblique evaporation. In this case, the actuator plate 412 can also be of the cantilever type constituted by a single piezoelectric substrate. In this case, depending on the structure, the pair of individual electrodes Eda opposed to each other in the same dummy channel C1*d* (or the same dummy channel C2*d*) are not necessarily electrically connected to each other. Therefore, the electrode separation by the additional processing is not necessary in some cases. Therefore, the electrode dividing groove 460 is not necessarily required to be formed.

(Cover Plate 413)

As shown in FIG. 2 through FIG. 5, the cover plate 413 is disposed so as to close the channels C1, C2 (the channel columns 421, 422) in the actuator plate 412. Specifically, the cover plate 413 is bonded to the upper surface (the bonding surface 472) of the actuator plate 412, and is provided with a plate-like structure.

As shown in FIG. 5, the cover plate 413 is provided with a pair of entrance side common ink chambers Rin1, Rin2 and a pair of exit side common ink chambers Rout1, Rout2. The entrance side common ink chambers Rin1, Rin2 and the exit side common ink chambers Rout1, Rout2 each extend along the X-axis direction, and are arranged side by side so as to be parallel to each other at predetermined intervals. Further, the entrance side common ink chamber Rin1 and the exit side common ink chamber Rout1 are each formed in an area corresponding to the channel column 421 (the plurality of channels C1) in the actuator plate 412. Meanwhile, the entrance side common ink chamber Rin2 and the exit side common ink chamber Rout2 are each formed in an area corresponding to the channel column 422 (the plurality of channels C2) in the actuator plate 412.

The entrance side common ink chamber Rin1 is formed in the vicinity of an inner end part along the Y-axis direction in the channels C1, and forms a groove section having a recessed shape (see FIG. 5). In areas corresponding respectively to the ejection channels C1*e* in the entrance side common ink chamber Rin1, there are respectively formed supply slits Sin1 penetrating the cover plate 413 along the thickness direction (the Z-axis direction) of the cover plate 413 (see FIG. 4). Similarly, the entrance side common ink chamber Rin2 is formed in the vicinity of an inner end part along the Y-axis direction in the channels C2, and forms a groove section having a recessed shape (see FIG. 5). In areas corresponding respectively to the ejection channels C2*e* in the entrance side common ink chamber Rin2, there are respectively formed supply slits Sin2 penetrating the cover plate 413 along the thickness direction of the cover plate 413 (see FIG. 4).

The exit side common ink chamber Rout1 is formed in the vicinity of an outer end part along the Y-axis direction in the channels C1, and forms a groove section having a recessed shape (see FIG. 5). In areas corresponding respectively to the ejection channels C1*e* in the exit side common ink chamber Rout1, there are respectively formed discharge slits Sout1 penetrating the cover plate 413 along the thickness direction of the cover plate 413 (see FIG. 4). Similarly, the exit side common ink chamber Rout2 is formed in the vicinity of an outer end part along the Y-axis direction in the channels C2, and forms a groove section having a recessed shape (see FIG. 5). In areas corresponding respectively to the ejection channels C2*e* in the exit side common ink chamber Rout2, there are also respectively formed discharge slits Sout2 penetrating the cover plate 413 along the thickness direction of the cover plate 413 (see FIG. 4).

In such a manner, the entrance side common ink chamber Rin1 and the exit side common ink chamber Rout1 are communicated with each of the ejection channels C1*e* via the supply slit Sin1 and the discharge slit Sout1 on the one hand, but are not communicated with each of the dummy channels C1*d* on the other hand (see FIG. 4 and FIG. 5). In other words, it is arranged that each of the dummy channels C1*d* is closed by a bottom part of the entrance side common ink chamber Rin1 and a bottom part of the exit side common ink chamber Rout1 (see FIG. 5).

Similarly, the entrance side common ink chamber Rin2 and the exit side common ink chamber Rout2 are communicated with each of the ejection channels C2*e* via the supply slit Sin2 and the discharge slit Sout2 on the one hand, but are not communicated with each of the dummy channels C2*d* on the other hand (see FIG. 4 and FIG. 5). In other words, it is arranged that each of the dummy channels C2*d* is closed by a bottom part of the entrance side common ink chamber Rin2 and a bottom part of the exit side common ink chamber Rout2 (see FIG. 5).

(Flow Channel Plate 40)

As shown in FIG. 3, the flow channel plate 40 is disposed on the upper surface of the cover plate 413, and has a predetermined flow channel (not shown) through which the ink 9 flows. Further, to the flow channel in such a flow channel plate 40, there are connected the flow channels 50*a*, 50*b* in the circulation mechanism 5 described above so as to achieve inflow of the ink 9 to the flow channel and outflow of the ink 9 from the flow channel, respectively. It should be noted that since it is arranged that the dummy channels C1*d*, C2*d* are closed by the bottom part of the cover plate 413 as described above, the ink 9 is supplied only to the ejection channels C1*e*, C2*e*, but does not inflow into the dummy channels C1*d*, C2*d*.

[Flow Channel Structure Around Ejection Channels C1*e*, C2*e*]

Then, the flow channel structure of the ink 9 in a part for communicating the supply slit Sin1, Sin2 and the discharge slit Sout1, Sout2 described above with the ejection channel C1*e*, C2*e* will be described in detail with reference to FIG. 4 (a cross-sectional configuration example of the vicinity of the ejection channels C1*e*, C2*e*) described above.

As shown in FIG. 4, in the head chip 41 according to the present embodiment, the cover plate 413 is provided with the supply slits Sin1, Sin2, the discharge slits Sout1, Sout2, and wall parts W1, W2. Specifically, the supply slits Sin1 and the discharge slits Sout1 are each a through hole through which the ink 9 flows to or from the ejection channel C1*e*, and the supply slits Sin2 and the discharge slits Sout2 are each a through hole through which the ink 9 flows to or from the ejection channel C2*e*. In detail, as indicated by the dotted arrows in FIG. 4, the supply slits Sin1, Sin2 are through holes for making the ink 9 inflow into the ejection channels C1*e*, C2*e*, respectively, and the discharge slits Sout1, Sout2 are through holes for making the ink 9 outflow from the inside of the ejection channels C1*e*, C2*e*, respectively.

Further, the wall part W1 described above is disposed between the entrance side common ink chamber Rin1 and the exit side common ink chamber Rout1 so as to cover above the ejection channels C1*e*. Similarly, the wall part W2 described above is disposed between the entrance side common ink chamber Rin2 and the exit side common ink chamber Rout2 so as to cover above the ejection channels C2*e*.

[Configuration of Individual Interconnections Wda, Common Interconnections Wdc, and Common Electrodes Edc2]

Then, the interconnections (the individual interconnections Wda, the common interconnections Wdc and the common electrodes Edc2) will be described with reference to FIG. 4 through FIG. 8.

As shown in FIG. 4 and FIG. 7, in an area corresponding to the periphery of the groove section S0 of the actuator plate 412 in the bottom surface of the cover plate 413, the common electrodes Edc2 for electrically connecting the plurality of common electrodes Edc located in the same channel column 421 (or the same channel column 422) on the actuator plate 412 side to each other are formed so as to extend in the X-axis direction. Thus, the plurality of common electrodes Edc is electrically connected to each other in the X-axis direction and is commonalized on the cover plate 413 side.

As shown in FIG. 4 and FIG. 7, the common electrodes Edc2 are also formed inside the supply slits Sin1, Sin2. Further, as shown in FIG. 5 and FIG. 8, the common electrodes Edc2 are also formed inside the exit side common ink chambers Rout1, Rout2, and the entrance side common ink chambers Rin1, Rin2.

Further, as shown in FIG. 7, on both end parts in the X-axis direction of the bottom surface of the cover plate 413, there are formed the common interconnections Wdc. Further, as shown in FIG. 7, on both end parts in the Y-axis direction of the bottom surface of the cover plate 413, there are formed the individual interconnections Wda. It should be noted that in FIG. 7, there are shown the common interconnections Wdc only on one end part side in the X-axis direction as the common interconnections Wdc. The common interconnections Wdc are formed in respective areas corresponding to the two channel columns 421, 422 (see FIG. 6). The common interconnection Wdc located in the area corresponding to the channel column 421 electrically connects the plurality of common electrodes Edc located in the channel column 421 and the FPC 441 located on the channel column 421 side to each other via the common electrodes Edc2. Similarly, the common interconnection Wdc located in the area corresponding to the channel column 422 electrically connects the plurality of common electrodes Edc located in the channel column 422 and the FPC 442 located on the channel column 422 side to each other via the common electrodes Edc2. In contrast, the individual interconnections Wda each electrically connect the pair of individual electrodes Eda opposed to each other via the ejection channel C1*e* (or the ejection channel C2*e*) to the FPC 441 (or the FPC 442).

[Operations and Functions/Advantages]

(A. Basic Operation of Printer 1)

In the printer 1, a recording operation (a printing operation) of images, characters, and so on to the recording paper P is performed in the following manner. It should be noted that as an initial state, it is assumed that the four types of ink tanks 3 (3Y, 3M, 3C, and 3B) shown in FIG. 1 are sufficiently filled with the ink 9 of the corresponding colors (the four colors), respectively. Further, there is achieved the state in which the inkjet heads 4 are filled with the ink 9 in the ink tanks 3 via the circulation mechanism 5, respectively.

In such an initial state, when operating the printer 1, the grit rollers 21 in the carrying mechanisms 2*a*, 2*b* rotate to thereby carry the recording paper P along the carrying direction d (the X-axis direction) between the grit rollers 21 and the pinch rollers 22. Further, at the same time as such a carrying operation, the drive motor 633 in the drive mechanism 63 respectively rotates the pulleys 631*a*, 631*b* to thereby operate the endless belt 632. Thus, the carriage 62 reciprocates along the width direction (the Y-axis direction) of the recording paper P while being guided by the guide rails 61*a*, 61*b*. Then, on this occasion, the four colors of ink 9 are appropriately ejected on the recording paper P by the respective inkjet heads 4 (4Y, 4M, 4C, and 4B) to thereby perform the recording operation of images, characters, and so on to the recording paper P.

(B. Detailed Operation in Inkjet Heads 4)

Then, the detailed operation (the jet operation of the ink 9) in the inkjet heads 4 will be described with reference to FIG. 1 through FIG. 5. Specifically, in the inkjet heads 4 (the side-shoot type) according to the present embodiment, the jet operation of the ink 9 using a shear mode is performed in the following manner.

Firstly, when the reciprocation of the carriage 62 (see FIG. 1) described above is started, the drive circuit on the circuit board described above applies the drive voltage to the drive electrodes Ed (the common electrodes Edc and the individual electrodes Eda) in the inkjet head 4 via the flexible printed circuit boards described above. Specifically, the drive circuit applies the drive voltage to the individual electrodes Eda disposed on the pair of drive walls Wd forming the ejection channel C1*e*, C2*e*. Thus, the pair of drive walls Wd each deform (see FIG. 3) so as to protrude toward the dummy channel C1*d*, C2*d* adjacent to the ejection channel C1*e*, C2*e*.

Here, as described above, in the actuator plate 412, the polarization direction differs along the thickness direction (the two piezoelectric substrates described above are stacked on one another), and at the same time, the drive electrodes Ed are formed in the entire area in the depth direction on the inner side surface in each of the drive walls Wd. Therefore, by applying the drive voltage using the drive circuit described above, it results that the drive wall Wd makes a flexion deformation to have a V shape centered on the intermediate position in the depth direction in the drive wall Wd. Further, due to such a flexion deformation of the drive wall Wd, the ejection channel C1*e*, C2*e* deforms as if the ejection channel C1*e*, C2*e* bulges. Incidentally, in the case in which the configuration of the actuator plate 412 is not the chevron type but is the cantilever type described above, the drive wall Wd makes the flexion deformation to have the V shape in the following manner. That is, in the case of the cantilever type, since it results that the drive electrode Ed is attached by the oblique evaporation to an upper half in the depth direction, by the drive force exerted only on the part provided with the drive electrode Ed, the drive wall Wd makes the flexion deformation (in the end part in the depth direction of the drive electrode Ed). As a result, even in this case, since the drive wall Wd makes the flexion deformation to have the V shape, it results that the ejection channel C1*e*, C2*e* deforms as if the ejection channel C1*e*, C2*e* bulges.

As described above, due to the flexion deformation caused by a piezoelectric thickness-shear effect in the pair of drive walls Wd, the capacity of the ejection channel C1*e*, C2*e* increases. Further, due to the increase of the capacity of the ejection channel C1*e*, C2*e*, it results that the ink 9 retained in the entrance side common ink chamber Rin1, Rin2 is induced into the ejection channel C1*e*, C2*e* (see FIG. 4).

Subsequently, the ink 9 having been induced into the ejection channel C1*e*, C2*e* in such a manner turns to a pressure wave to propagate to the inside of the ejection channel C1*e*, C2*e*. Then, the drive voltage to be applied to the drive electrodes Ed becomes 0 (zero) V at the timing at which the pressure wave has reached the nozzle hole H1, H2 of the nozzle plate 411. Thus, the drive walls Wd are restored from the state of the flexion deformation described above, and as a result, the capacity of the ejection channel C1*e*, C2*e* having once increased is restored again (see FIG. 3).

When the capacity of the ejection channel C1*e*, C2*e* is restored in such a manner, the internal pressure of the ejection channel C1*e*, C2*e* increases, and the ink 9 in the ejection channel C1*e*, C2*e* is pressurized. As a result, the ink 9 having a droplet shape is ejected (see FIG. 3 and FIG. 4) toward the outside (toward the recording paper P) through the nozzle hole H1, H2. The jet operation (the ejection operation) of the ink 9 in the inkjet head 4 is performed in such a manner, and as a result, the recording operation of images, characters, and so on to the recording paper P is performed.

In particular, the nozzle holes H1, H2 of the present embodiment each have the tapered cross-sectional shape gradually decreasing in diameter toward the outlet (see FIG. 3 and FIG. 4) as described above, and can therefore eject the ink 9 straight (good in straightness) at high speed. Therefore, it becomes possible to perform recording high in image quality.

(C. Circulation Operation of Ink 9)

Then, the circulation operation of the ink 9 by the circulation mechanism 5 will be described in detail with reference to FIG. 1 and FIG. 4.

As shown in FIG. 1, in the printer 1, the ink 9 is fed by the liquid feeding pump 52*a* from the inside of the ink tank 3 to the inside of the flow channel 50*a*. Further, the ink 9 flowing through the flow channel 50*b* is fed by the liquid feeding pump 52*b* to the inside of the ink tanks 3.

On this occasion, in the inkjet head 4, the ink 9 flowing from the inside of the ink tank 3 via the flow channel 50*a* inflows into the entrance side common ink chambers Rin1, Rin2. As shown in FIG. 4, the ink 9 having been supplied to these entrance side common ink chambers Rin1, Rin2 is supplied to the ejection channels C1*e*, C2*e* in the actuator plate 412 via the supply slits Sin1, Sin2.

Further, as shown in FIG. 4, the ink 9 in the ejection channels C1*e*, C2*e* flows into the exit side common ink chambers Rout1, Rout2 via the discharge slits Sout1, Sout2, respectively. The ink 9 having been supplied to these exit side common ink chambers Rout1, Rout2 is discharged to the flow channel 50*b* to thereby outflow from the inkjet head 4. Then, the ink 9 having been discharged to the flow channel 50*b* is returned to the inside of the ink tank 3 as a result. In such a manner, the circulation operation of the ink 9 by the circulation mechanism 5 is achieved.

Here, in the inkjet head which is not the circulation type, in the case in which ink of a fast drying type is used, there is a possibility that a local increase in viscosity or local solidification of the ink occurs due to drying of the ink in the vicinity of the nozzle hole, and as a result, a failure such as an ink ejection failure occurs. In contrast, in the inkjet heads 4 (the circulation type inkjet heads) according to the present embodiment, since the fresh ink 9 is always supplied to the vicinity of the nozzle holes H1, H2, the failure such as the failure in ejection of the ink described above is prevented as a result.

(D. Functions/Advantages)

Then, the functions and the advantages in the head chip 41, the inkjet head 4 and the printer 1 according to the present embodiment will be described in detail while comparing with a comparative example.

Comparative Example

Figure 9:
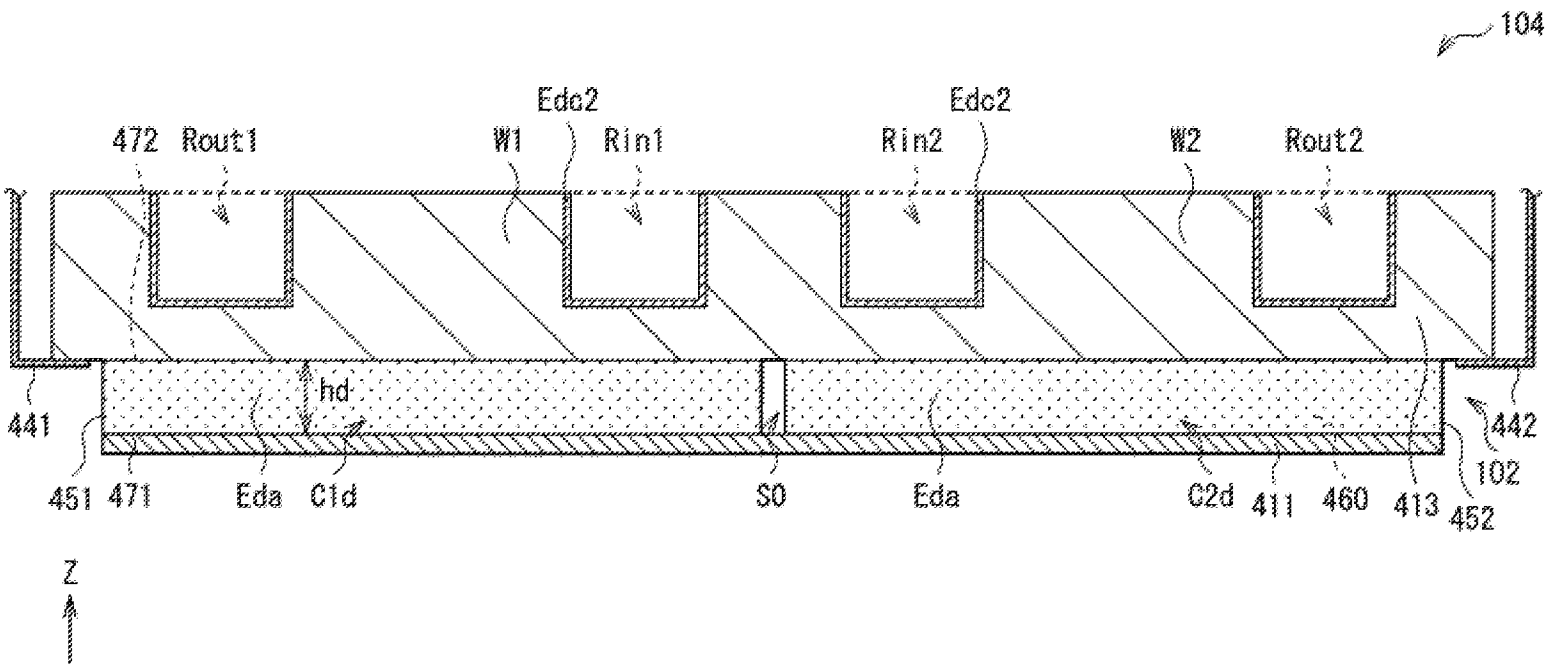
FIG. 9 is a schematic diagram showing a cross-sectional configuration example of a head chip related to a comparative example.

FIG. 9 is a diagram schematically showing a cross-sectional configuration example of a head chip (a head chip 104) according to a comparative example, and corresponds to a cross-sectional configuration example of the vicinity of the dummy channels C1*d*, C2*d*. The head chip 104 of the comparative example is provided with an actuator plate 102 instead of the actuator plate 412 in the head chip 41 according to the present embodiment shown in FIG. 5. In the actuator plate 412 in the head chip 41 according to the present embodiment, the dummy channel C1*d*, C2*d* partially opens in the bonding surface 471 of the actuator plate 412 with the nozzle plate 411 to form an opening 482 as shown in FIG. 5. In contrast, in the actuator plate 102 in the head chip 104 of the comparative example, the dummy channel C1*d*, C2*d* wholly opens in the bonding surface 471 with the nozzle plate 411 as shown in FIG. 9. Thus, in the second direction described above, the groove depth hd in the dummy channels C1*d*, C2*d* is made roughly constant. Further, the opening in the dummy channel C1*d* is formed in the second direction described above up to the first end surface 451. Further, the opening in the dummy channel C2*d* is formed in the second direction described above up to the second end surface 452. Thus, the dummy channels C1*d*, C2*d* wholly open in the second direction between the first end surface 451 and the second end surface 452, and are exposed on the bonding surface 471 with the nozzle plate 411.

In such a head chip 104 of the comparative example, since the exposure of the dummy channels C1*d*, C2*d* is made large in the bonding surface 471 with the nozzle plate 411, the strength of the actuator plate 102 is low, and there is a possibility that the drive wall Wd is apt to fracture or break even against a light impact to cause a defect. Thus, the fabrication yield becomes worse in some cases. Further, in the head chip 104 of the comparative example, there is a possibility that an adhesive flows into the dummy channels C1*d*, C2*d* at the stage of sealing the tail parts 420 (see FIG. 2) after connecting the flexible printed circuit boards 441, 442 in the actuator plate 102, and a crack occurs in the drive wall Wd and so on due to cure shrinkage, or the motion of the drive wall Wd in the ejection action is affected to make the ejection characteristics worse. Therefore, in the head chip 104 of this comparative example, there is a possibility that the ejection stability is damaged. Due to these circumstances, in the head chip 104 of this comparative example, the reliability is damaged in some cases.

Present Embodiment

In contrast, in the head chip 41 according to the present embodiment, there is provided the structure in which the dummy channel C1*d*, C2*d* does not wholly open in the bonding surface 471 of the actuator plate 412 with the nozzle plate 411, but the partial opening 482 is formed as shown in FIG. 5.

As described above, in the head chip 41 according to the present embodiment, by forming the opening 482 of the dummy channel C1*d*, C2*d* as the partial opening, it is possible to reduce the exposure of the dummy channel C1*d*, C2*d* to the nozzle plate 411 surface side compared to the case in which the dummy channels C1*d*, C2*d* wholly open as in the head chip 104 of the comparative example. Thus, it is possible to increase the strength of the actuator plate 412, and it becomes possible to improve the fabrication yield. Further, in the case in which the nozzle plate 411 is made of metal, there is a possibility that the short circuit between the individual electrode Eda of the dummy channel C1*d*, C2*d* occurs, but it is possible to make such short circuit difficult to occur. Therefore, in the present embodiment, it becomes possible to improve the ejection stability in the head chip 41, the inkjet head 4 and the printer 1 compared to the comparative example described above. Further, since it is possible to increase the strength of the actuator plate 412, it becomes possible to enhance the reliability.

It should be noted that such an advantage is substantially the same even in the case of the structure in which the drive electrode Ed is not formed beyond the intermediate position in the depth direction on the inner side surface of the drive wall Wd using the vapor deposition or the like, and the electrode dividing groove 460 is not formed.

In addition, in the head chip 41 according to the present embodiment, there is provided the structure in which the dummy channels C1*d*, C2*d* are closed respectively in the predetermined end surfaces (the first end surface 451, the second end surface 452) of the actuator plate 412 in the second direction described above. Further, the electrode dividing groove 460 is formed on the inner side of the predetermined end surfaces of the actuator plate 412 in the second direction described above.

Thus, in the head chip 41 according to the present embodiment, it is possible to increase the support strength in the predetermined end surfaces of the actuator plate 412. In addition, in the process of applying the adhesive for sealing the drive electrodes Ed or bonding other members in the vicinity of the predetermined end surface of the actuator plate 412, it is possible to prevent the adhesive from inflowing into the dummy channels C1*d*, C2*d*. Thus, it is possible to prevent the adhesive from hindering the motion of the drive wall Wd for partitioning the ejection channel C1*e*, C2*e* and the dummy channel C1*d*, C2*d* from each other. Therefore, in the present embodiment, it becomes possible to further improve the ejection stability in the head chip 41, the inkjet head 4 and the printer 1 compared to the comparative example described above. Further, it is possible to increase the strength of the actuator plate 412, and thus, it becomes possible to further enhance the reliability.

2. Modified Examples

Then, some modified examples (Modified Examples 1 through 4) of the embodiment described above will be described. It should be noted that the same constituents as those in the embodiment are denoted by the same reference symbols, and the description thereof will arbitrarily be omitted.

Modified Example 1

Figure 10:
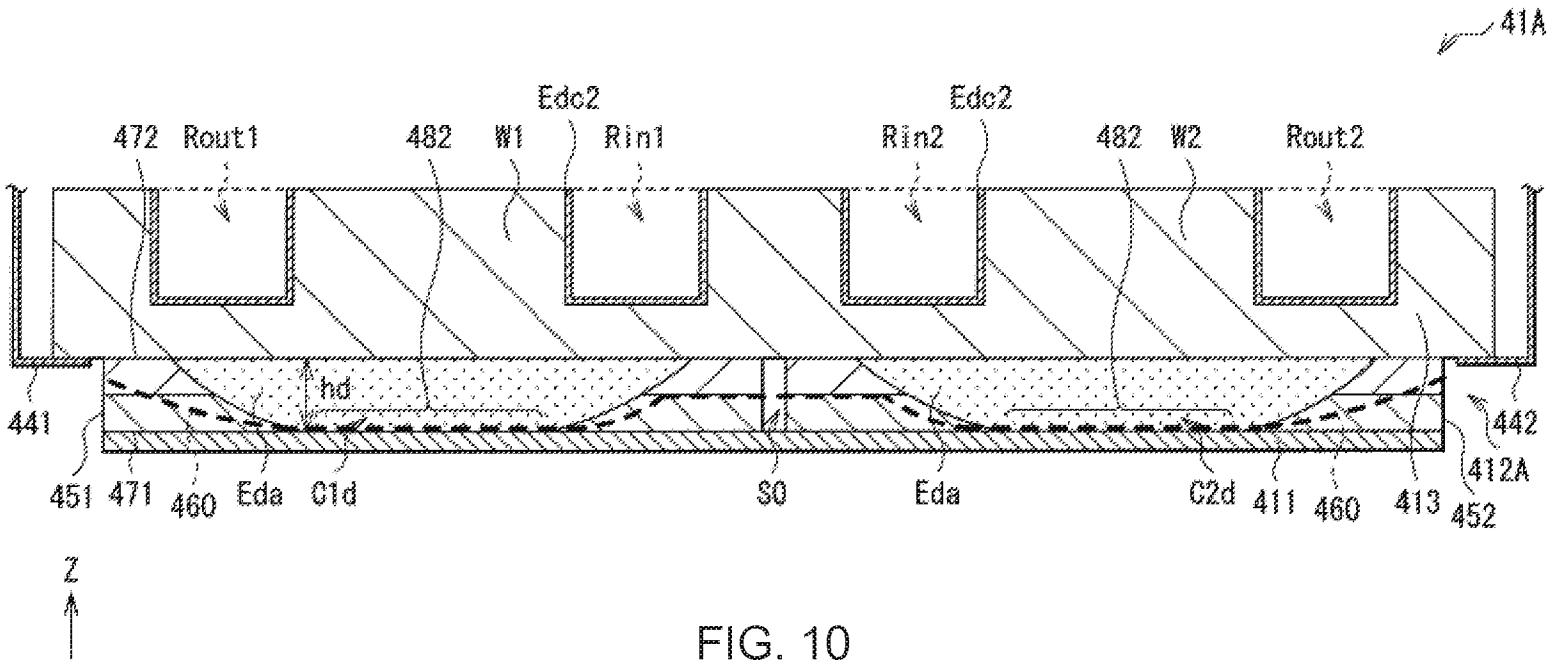
FIG. 10 is a schematic diagram showing a cross-sectional configuration example of the head chip related to Modified Example 1.

FIG. 10 is a diagram schematically showing a cross-sectional configuration example of a head chip (a head chip 41A) according to Modified Example 1, and corresponds to a cross-sectional configuration example of the vicinity of the dummy channels C1*d*, C2*d*. The head chip 41A (an actuator plate 412A) of Modified Example 1 corresponds to what is obtained by changing the structure in the vicinity of the dummy channels C1*d*, C2*d* in the head chip 41 (the actuator plate 412) of the embodiment shown in FIG. 5, and the rest of the configuration is made basically the same.

Specifically, in the head chip 41 (FIG. 5) according to the embodiment, the electrode dividing groove 460 is formed on the inner side of the predetermined end surfaces (the first end surface 451, the second end surface 452) of the actuator plate 412 in the second direction described above. In contrast, in the head chip 41A (FIG. 10) according to Modified Example 1, the electrode dividing groove 460 extends up to the predetermined end surfaces (the first end surface 451, the second end surface 452) of the actuator plate 412A in the second direction, and is exposed.

Also in the head chip 41A of Modified Example 1 having such a configuration, it is possible to obtain basically the same advantage due to substantially the same function as that of the head chip 41 of the embodiment.

Further, in the head chip 41A of Modified Example 1, since the electrode dividing groove 460 extends up to the predetermined end surfaces of the actuator plate 412A to be exposed on the predetermined end surfaces, it is possible to prevent impurities (dust) from getting stuck in the dummy channels C1*d*, C2*d*. In the case in which the impurities have conductivity, there is a possibility that the individual electrodes Eda opposed to each other in the dummy channel C1*d*, C2*d* are shorted to each other. However, in the head chip 41A of Modified Example 1, such short circuit can be prevented.

Modified Example 2

Figure 11:
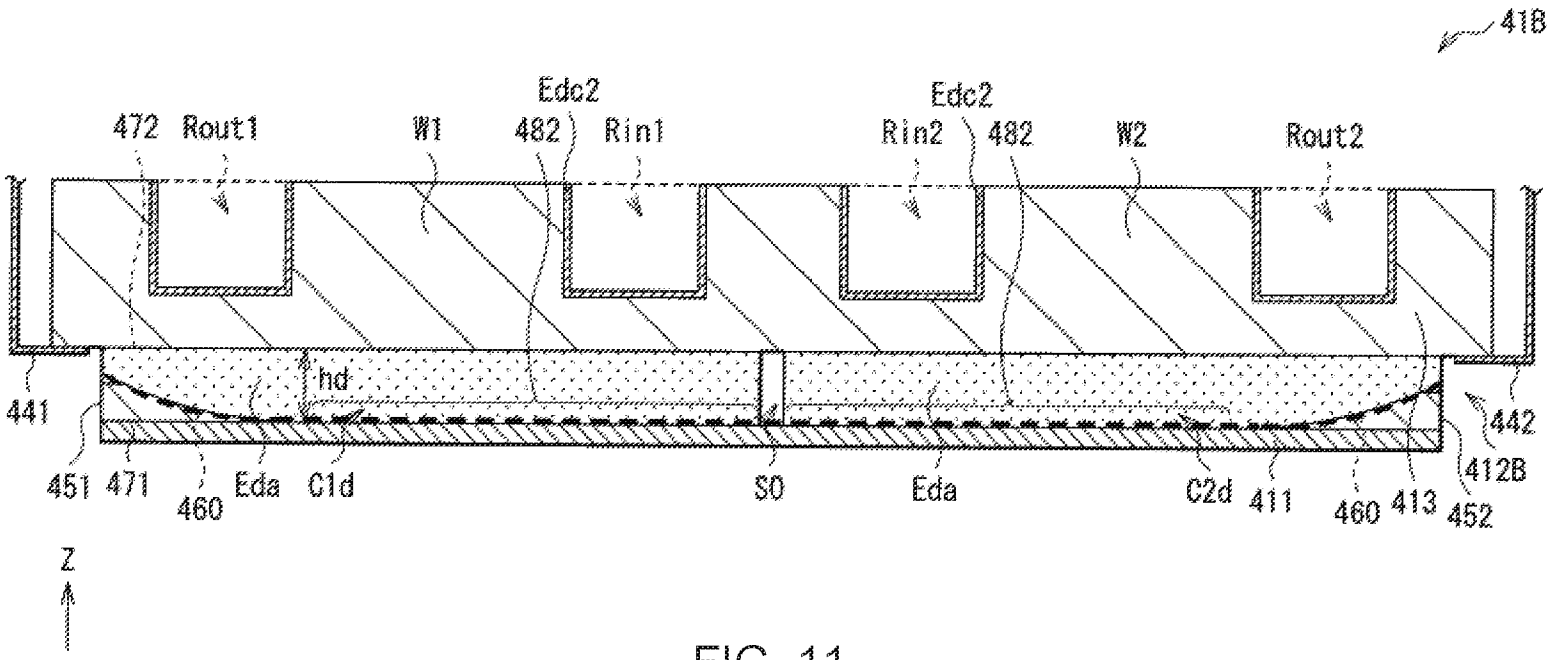
FIG. 11 is a schematic diagram showing a cross-sectional configuration example of the head chip related to Modified Example 2.

FIG. 11 is a diagram schematically showing a cross-sectional configuration example of a head chip (a head chip 41B) according to Modified Example 2, and corresponds to a cross-sectional configuration example of the vicinity of the dummy channels C1*d*, C2*d*.

The head chip 41B (an actuator plate 412B) of Modified Example 2 corresponds to what is obtained by changing the structure in the vicinity of the dummy channels C1*d*, C2*d* in the head chip 41 (the actuator plate 412) of the embodiment shown in FIG. 5, and the rest of the configuration is made basically the same.

Specifically, in the head chip 41 (FIG. 5) according to the embodiment, there is provided the structure in which the dummy channels C1*d*, C2*d* are closed respectively in the predetermined end surfaces (the first end surface 451, the second end surface 452) of the actuator plate 412 in the second direction described above. Further, in the head chip 41 (FIG. 5) of the embodiment, the electrode dividing groove 460 is formed on the inner side of the predetermined end surfaces of the actuator plate 412 in the second direction described above. In contrast, in the head chip 41B (FIG. 11) of Modified Example 2, the dummy channel C1*d*, C2*d* partially opens in the predetermined end surface of the actuator plate 412B in the second direction. Further, similarly to the head chip 41A (FIG. 10) of Modified Example 1, the electrode dividing groove 460 extends up to the predetermined end surfaces of the actuator plate 412B in the second direction, and is exposed. Further, in the head chip 41B of Modified Example 2, the respective openings 482 in the dummy channels C1*d*, C2*d* extend up to the groove section S0 on the bonding surface 471 of the actuator plate 412B with the nozzle plate 411. Thus, there is provided a structure in which the area between the dummy channel C1*d* and the dummy channel C2*d* (the vicinity of the groove section S0) wholly communicates the dummy channels with each other, but are not wholly blocked.

It should be noted that the phrase that the dummy channel C1*d*, C2*d* "partially opens" in the predetermined end surface of the actuator plate 412B in the section direction means that the dummy channel C1*d*, C2*d* does not have a closed structure (a blocked structure) as shown in FIG. 5 in the predetermined end surface, but is in the state of having a part not blocked in the Z-axis direction.

Also in the head chip 41B of Modified Example 2 having such a configuration, it is possible to obtain basically the same advantage due to substantially the same function as that of the head chip 41 of the embodiment.

Further, in the head chip 41B of Modified Example 2, since the dummy channel C1*d*, C2*d* partially opens in the predetermined end surface of the actuator plate 412B, and further, the electrode dividing groove 460 is exposed on the predetermined end surfaces, it is possible to further prevent impurities (dust) from getting stuck in the dummy channels C1*d*, C2*d*. In the case in which the impurities have conductivity, there is a possibility that the individual electrodes Eda are shorted to each other, but in the head chip 41B of Modified Example 2, it is possible to prevent such short circuit. Further, since there is adopted the structure in which the area between the dummy channel C1*d* and the dummy channel C2*d* (the vicinity of the groove section S0) is not wholly blocked, it is possible to prevent dust from getting stuck between the dummy channel C1*d* and the dummy channel C2*d* to thereby prevent the individual electrodes Eda from being shorted to each other therebetween.

Modified Example 3

Figure 12:
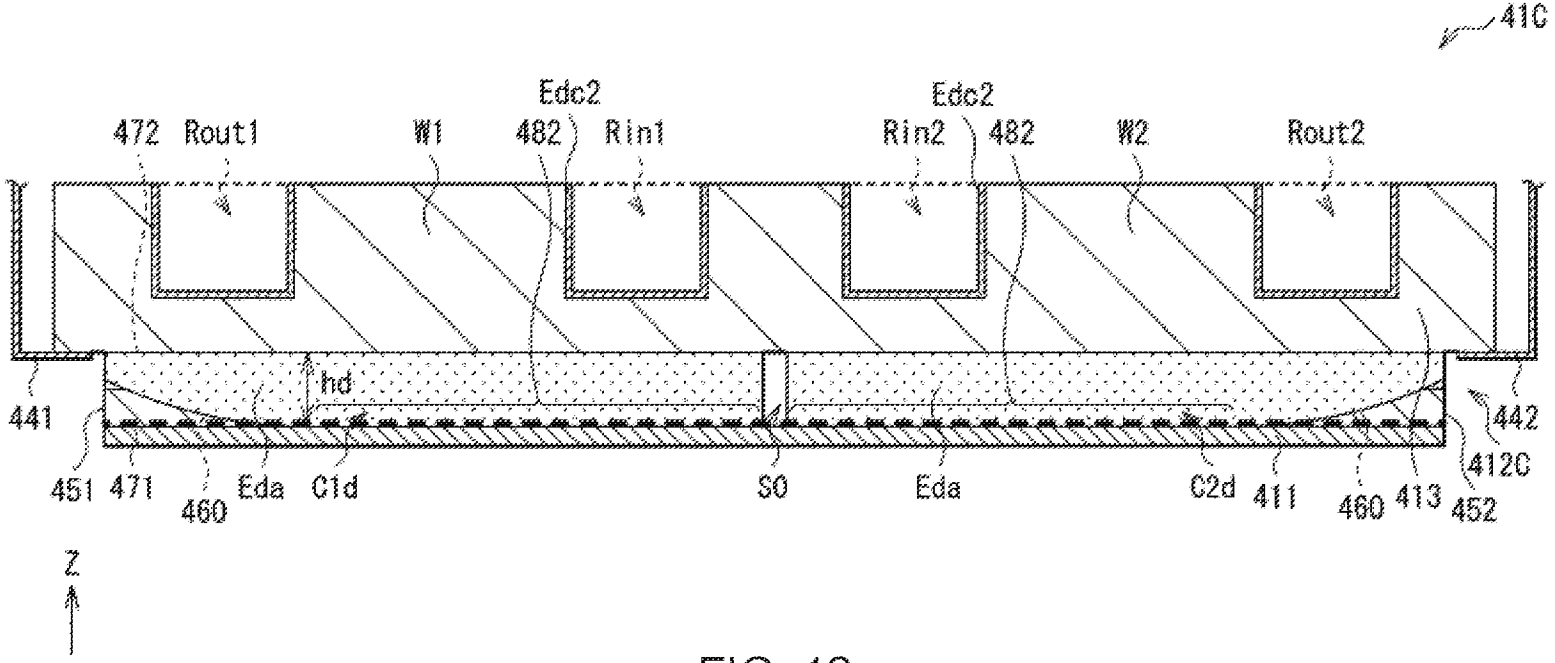
FIG. 12 is a schematic diagram showing a cross-sectional configuration example of the head chip related to Modified Example 3.

FIG. 12 is a diagram schematically showing a cross-sectional configuration example of a head chip (a head chip 41C) according to Modified Example 3, and corresponds to a cross-sectional configuration example of the vicinity of the dummy channels C1*d*, C2*d*.

The head chip 41C (an actuator plate 412C) of Modified Example 3 corresponds to what is obtained by changing the structure in the vicinity of the dummy channels C1*d*, C2*d* in the head chip 41 (the actuator plate 412) of the embodiment shown in FIG. 5, and the rest of the configuration is made basically the same.

Specifically, in the head chip 41 (FIG. 5) according to the embodiment, there is provided the structure in which the dummy channels C1*d*, C2*d* are closed respectively in the predetermined end surfaces (the first end surface 451, the second end surface 452) of the actuator plate 412 in the second direction described above. Further, in the head chip 41 (FIG. 5) of the embodiment, the electrode dividing groove 460 is formed on the inner side of the predetermined end surfaces of the actuator plate 412 in the second direction described above. In contrast, in the head chip 41C (FIG. 12) of Modified Example 3, similarly to the head chip 41B (FIG.

11) of Modified Example 2, the dummy channel C1*d*, C2*d* partially opens in the predetermined end surface of the actuator plate 412C in the second direction. Further, in the head chip 41C of Modified Example 3, the electrode dividing groove 460 is formed so as to wholly be exposed throughout the area from the first end surface 451 to the second end surface 452 in the bonding surface 471 of the actuator plate 412C with the nozzle plate 411. Further, in the head chip 41C of Modified Example 3, the respective openings 482 in the dummy channels C1*d*, C2*d* extend up to the groove section S0 on the bonding surface 471 of the actuator plate 412C with the nozzle plate 411.

Also in the head chip 41C of Modified Example 3 having such a configuration, it is possible to obtain basically the same advantage due to substantially the same function as that of the head chip 41 of the embodiment.

Further, in the head chip 41C of Modified Example 3, since the electrode dividing groove 460 is formed so as to be wholly exposed on the nozzle plate 411 surface side throughout the area from the first end surface 451 to the second end surface 452, it is possible to further prevent the short circuit due to impurities compared to the head chip 41B of Modified Example 2. Further, since the minimum structure is only provided in the dummy channel C1*d*, C2*d*, it is possible to further suppress the harmful influence on the motion of the drive wall Wd in the ejection action to stabilize the ejection characteristics compared to the head chip 41B of Modified Example 2.

Modified Example 4

Figure 13:
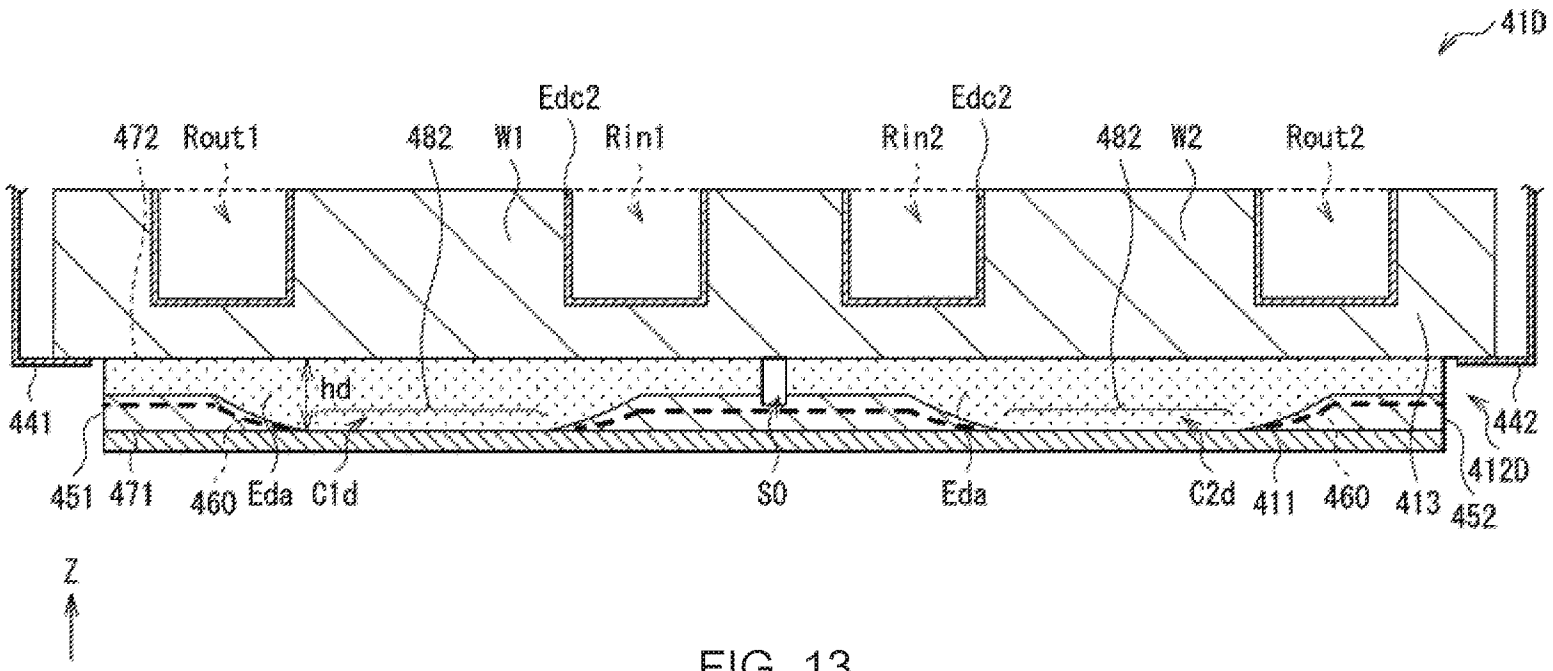
FIG. 13 is a schematic diagram showing a cross-sectional configuration example of the head chip related to Modified Example 4.

FIG. 13 is a diagram schematically showing a cross-sectional configuration example of a head chip (a head chip 41D) according to Modified Example 4, and corresponds to a cross-sectional configuration example of the vicinity of the dummy channels C1*d*, C2*d*. The head chip 41D (an actuator plate 412D) of Modified Example 4 corresponds to what is obtained by changing the structure in the vicinity of the dummy channels C1*d*, C2*d* in the head chip 41 (the actuator plate 412) of the embodiment shown in FIG. 5, and the rest of the configuration is made basically the same.

Specifically, in the head chip 41 (FIG. 5) according to the embodiment, there is provided the structure in which the dummy channels C1*d*, C2*d* are closed respectively in the predetermined end surfaces (the first end surface 451, the second end surface 452) of the actuator plate 412 in the second direction described above. Further, in the head chip 41 (FIG. 5) of the embodiment, the electrode dividing groove 460 is formed on the inner side of the predetermined end surfaces of the actuator plate 412 in the second direction described above. In contrast, in the head chip 41D (FIG. 13) of Modified Example 4, similarly to the head chip 41B (FIG. 11) of Modified Example 2, the dummy channel C1*d*, C2*d* partially opens in the predetermined end surface of the actuator plate 412D in the second direction. In the head chip 41D of Modified Example 4, similarly to the head chip 41B of Modified Example 2, the electrode dividing groove 460 extends up to the predetermined end surfaces of the actuator plate 412D in the second direction, and is exposed. Further, there is provided a structure in which the area between the dummy channel C1*d* and the dummy channel C2*d* (the vicinity of the groove section S0) partially communicates the dummy channels with each other, but includes a part not blocked.

Also in the head chip 41D of Modified Example 4 having such a configuration, it is possible to obtain basically the same advantage due to substantially the same function as that of the head chip 41 of the embodiment.

Further, in the head chip 41D of Modified Example 4, since the dummy channel C1*d*, C2*d* partially opens in the predetermined end surface of the actuator plate 412B, and further, the electrode dividing groove 460 is exposed on the predetermined end surfaces, it is possible to further prevent impurities (dust) from getting stuck in the dummy channels C1*d*, C2*d*. In the case in which the impurities have conductivity, there is a possibility that the individual electrodes Eda are shorted to each other, but in the head chip 41D of Modified Example 4, it is possible to prevent such short circuit. Further, since there is adopted the structure in which a part of the area between the dummy channel C1*d* and the dummy channel C2*d* (the vicinity of the groove section S0) is not blocked, it is possible to prevent dust from getting stuck between the dummy channel C1*d* and the dummy channel C2*d* to thereby prevent the individual electrodes Eda from being shorted to each other therebetween.

3. Other Modified Examples

The present disclosure is described hereinabove citing the embodiment and some modified examples, but the present disclosure is not limited to the embodiment and so on, and a variety of modifications can be adopted.

For example, in the embodiment described above, the description is presented specifically citing the configuration examples (the shapes, the arrangements, the number and so on) of each of the members in the printer, the inkjet head and the head chip, but those described in the above embodiment and so on are not limitations, and it is possible to adopt other shapes, arrangements, numbers and so on. Further, the values or the ranges, the magnitude relation and so on of a variety of parameters described in the above embodiment and so on are not limited to those described in the above embodiment and so on, but can also be other values or ranges, other magnitude relation and so on.

Specifically, for example, in the embodiment described above, the description is presented citing the inkjet head 4 of the two column type (having the two nozzle columns An1, An2), but the example is not a limitation. Specifically, for example, it is also possible to adopt an inkjet head of a single column type (having a single nozzle column), or an inkjet head of a multi-column type (having three or more nozzle columns) with three or more columns (e.g., three columns or four columns).

Further, for example, in the embodiment described above and so on, there is described the case in which the ejection channels (the ejection grooves) and the dummy channels (the non-ejection grooves) each extend along the oblique direction in the actuator plate 412, but this example is not a limitation. Specifically, it is also possible to arrange that, for example, the ejection channels and the dummy channels extend along the Y-axis direction in the actuator plate 412.

Further, for example, the cross-sectional shape of each of the nozzle holes H1, H2 is not limited to the circular shape as described in the above embodiment and so on, but can also be, for example, an elliptical shape, a polygonal shape such as a triangular shape, or a star shape.

Further, in the embodiment described above, the description is presented citing the circulation type inkjet head for using the ink 9 while circulating the ink 9 mainly between the ink tank and the inkjet head as an example, but the example is not a limitation. Specifically, it is also possible to apply the present disclosure to a non-circulation type inkjet head using the ink 9 without circulating the ink 9.

Further, the series of processes described in the above embodiment and so on can be arranged to be performed by hardware (a circuit), or can also be arranged to be performed by software (a program). In the case of arranging that the series of processes is performed by the software, the software is constituted by a program group for making the computer perform the functions. The programs can be incorporated in advance in the computer described above, and are then used, or can also be installed in the computer described above from a network or a recording medium and are then used.

In addition, in the above embodiment, the description is presented citing the printer 1 (the inkjet printer) as a specific example of the "liquid jet recording device" in the present disclosure, but this example is not a limitation, and it is also possible to apply the present disclosure to other devices than the inkjet printer. In other words, it is also possible to arrange that the "head chip" and the "liquid jet head" (the inkjet heads) of the present disclosure are applied to other devices than the inkjet printer. Specifically, for example, it is also possible to arrange that the "head chip" and the "liquid jet head" of the present disclosure are applied to a device such as a facsimile or an on-demand printer.

In addition, it is also possible to apply the variety of examples described hereinabove in arbitrary combination.

It should be noted that the advantages described in the specification are illustrative only but are not a limitation, and another advantage can also be provided.

Further, the present disclosure can also take the following configurations.

<1>

A head chip adapted to jet liquid comprising an actuator plate having a plurality of ejection grooves and a plurality of non-ejection grooves alternately arranged in parallel to each other along a first direction and each extending in a second direction crossing the first direction; and a nozzle plate having a plurality of nozzle holes individually communicated with the plurality of ejection grooves, and to be bonded to the actuator plate, wherein the non-ejection grooves each partially open in a bonding surface of the actuator plate with the nozzle plate.

<2>

The head chip according to <1>, wherein the non-ejection grooves are each closed in a predetermined end surface of the actuator plate in the second direction.

<3>

The head chip according to <1> or <2>, wherein the actuator plate further includes a plurality of individual electrodes formed on respective inner surfaces of the plurality of non-ejection grooves, and electrode dividing grooves each extending along the second direction, and provided to respective bottom surfaces of the plurality of non-ejection grooves so as to electrically separate the respective individual electrodes into one side surface side and the other side surface side in the respective non-ejection grooves, and the electrode dividing grooves are each formed on an inner side of a predetermined end surface of the actuator plate in the second direction.

<4>

The head chip according to <1> or <2>, wherein the actuator plate further includes a plurality of individual electrodes formed on respective inner surfaces of the plurality of non-ejection grooves, and electrode dividing grooves each extending along the second direction, and provided to respective bottom surfaces of the plurality of non-ejection grooves so as to electrically separate the respective individual electrodes into one side surface side and the other side surface side in the respective non-ejection grooves, and the electrode dividing grooves each extend up to a predetermined end surface of the actuator plate in the second direction.

<5>

The head chip according to <4>, wherein the actuator plate has a first end surface and a second end surface facing to an opposite side to the first end surface as the predetermined end surface in the second direction, and the electrode dividing grooves are each formed so as to be exposed throughout an area from the first end surface to the second end surface in the bonding surface of the actuator plate with the nozzle plate.

<6>

The head chip according to any one of <1>, <4> and <5>, wherein the non-ejection grooves each open in a predetermined end surface of the actuator plate in the second direction.

<7>

A liquid jet head comprising the head chip according to any one of <1> to <6>.

<8>

A liquid jet recording device comprising the liquid jet head according to <7>; and a containing section adapted to contain the liquid.

What is claimed is:

1. A head chip wherein the non-ejection grooves each partially open in a bonding surface of the actuator plate with the nozzle plate, and wherein an opening of the non-ejection grooves in the bonding surface is shorter in the second direction than an opening of the non-ejection grooves in an upper surface of the actuator plate to a bonding surface with a cover plate;

and the non-ejection grooves are each closed on both ends in a predetermined end surface of the actuator plate in the second direction.

2. The head chip according to claim 1, wherein the actuator plate further includes a plurality of individual electrodes formed on respective inner surfaces of the plurality of non-ejection grooves, and electrode dividing grooves each extending along the second direction, and provided to respective bottom surfaces of the plurality of non-ejection grooves so as to electrically separate the respective individual electrodes into one side surface side and the other side surface side in the respective non-ejection grooves, and the electrode dividing grooves are each formed on an inner side of a predetermined end surface of the actuator plate in the second direction.

3. The head chip according to claim 1, wherein the actuator plate further includes a plurality of individual electrodes formed on respective inner surfaces of the plurality of non-ejection grooves, and electrode dividing grooves each extending along the second direction, and provided to respective bottom surfaces of the plurality of non-ejection grooves so as to electrically separate the respective individual electrodes into one side surface side and the other side surface side in the respective non-ejection grooves, and the electrode dividing grooves each extend up to a predetermined end surface of the actuator plate in the second direction.

4. The head chip according to claim 3, wherein the actuator plate has a first end surface and a second end surface facing to an opposite side to the first end surface as the predetermined end surface in the second direction, and the electrode dividing grooves are each formed so as to be exposed throughout an area from the first end surface to the second end surface in the bonding surface of the actuator plate with the nozzle plate.

5. The head chip according to claim 1, wherein the non-ejection grooves each open in a predetermined end surface of the actuator plate in the second direction.

6. A liquid jet head comprising the head chip according to claim 1.

7. A liquid jet recording device comprising:

the liquid jet head according to claim 6; and a containing section adapted to contain the liquid.

* * * * *